US010751252B2

(12) United States Patent
Carrel et al.

(10) Patent No.: US 10,751,252 B2
(45) Date of Patent: Aug. 25, 2020

(54) ADAPTOR FOR COUPLING WITH A MEDICAL CONTAINER

(71) Applicant: BECTON DICKINSON HOLDINGS PTE. LTD., Singapore (SG)

(72) Inventors: Franck Carrel, Saint Jean de Vaulx (FR); Frédéric Perot, Saint Paul de Varces (FR)

(73) Assignee: BECTON DICKINSON HOLDINGS PTE. LTD., Singapore (SG)

( * ) Notice: Subject to any disclaimer, the term of this patent is extended or adjusted under 35 U.S.C. 154(b) by 631 days.

(21) Appl. No.: 15/493,477

(22) Filed: Apr. 21, 2017

(65) Prior Publication Data

US 2017/0216144 A1 Aug. 3, 2017

Related U.S. Application Data

(62) Division of application No. 14/375,203, filed as application No. PCT/SG2013/000042 on Feb. 1, 2013, now Pat. No. 9,668,939.

(30) Foreign Application Priority Data

Feb. 2, 2012 (SG) ..... 201200771
Aug. 2, 2012 (EP) ..... 12305958

(51) Int. Cl.
*A61J 1/20* (2006.01)
*A61J 1/14* (2006.01)
*A61J 7/04* (2006.01)

(52) U.S. Cl.
CPC ..... *A61J 1/2096* (2013.01); *A61J 1/1406* (2013.01); *A61J 1/1425* (2015.05); *A61J 1/1443* (2013.01); *A61J 1/201* (2015.05); *A61J 1/2055* (2015.05); *A61J 1/2075* (2015.05); *A61J 1/2082* (2015.05); *A61J 7/0472* (2013.01); *A61J 1/2058* (2015.05); *A61J 2205/50* (2013.01); *Y10T 137/9029* (2015.04)

(58) Field of Classification Search
CPC ..... A61J 14/1412–1437; A61J 14/16; A61J 14/20; A61J 14/2003–2086
See application file for complete search history.

(56) References Cited

U.S. PATENT DOCUMENTS 3,940,003 A 2/1976 Larson
4,564,045 A 1/1986 Koch et al.
4,564,054 A 1/1986 Gustaysson
(Continued)

FOREIGN PATENT DOCUMENTS

CN 1133003 A 10/1996
EP 0311787 A2 4/1989
(Continued)

*Primary Examiner* — Benjamin J Klein
(74) *Attorney, Agent, or Firm* — The Webb Law Firm

(57) ABSTRACT

An adaptor for coupling with a vial having a collar closed by a septum, the septum having an outer surface directed towards the outside of the vial, the adaptor comprising: a gripping member for securing the adaptor to the vial, the gripping member being capable of being laterally mounted on the collar of the vial and a pierceable elastomeric piece having at least a part intended to be in contact with the outer surface of the septum when the adaptor is secured on the vial. Also, an assembly including such an adaptor and a vial.

11 Claims, 17 Drawing Sheets

(56) References Cited

U.S. PATENT DOCUMENTS

| | | | | |
|---|---|---|---|---|
| 4,576,211 | A | 3/1986 | Valentini et al. | |
| 4,768,568 | A | 9/1988 | Fournier et al. | |
| 4,872,494 | A | 10/1989 | Coccia | |
| 5,117,875 | A | 6/1992 | Marrucchi | |
| 5,340,359 | A | 8/1994 | Segura Badia | |
| 5,342,319 | A | 8/1994 | Watson et al. | |
| 5,454,409 | A | 10/1995 | McAffer et al. | |
| 5,498,253 | A | 3/1996 | Sward et al. | |
| 5,533,994 | A | 7/1996 | Meyer | |
| 5,620,433 | A | 4/1997 | Aswad et al. | |
| 5,678,718 | A | 10/1997 | Morris et al. | |
| 5,772,652 | A | 6/1998 | Zielinksi | |
| 5,827,262 | A | 10/1998 | Neftel et al. | |
| 5,829,589 | A | 11/1998 | Nguyen et al. | |
| 5,887,633 | A | 3/1999 | Yale et al. | |
| 6,258,078 | B1 | 7/2001 | Thilly | |
| 6,453,956 | B2 | 9/2002 | Safabash | |
| 6,571,837 | B2 | 6/2003 | Jansen et al. | |
| 6,626,309 | B1 | 9/2003 | Jansen et al. | |
| 6,715,520 | B2 * | 4/2004 | Andreasson | A61J 1/2096 141/2 |
| 6,880,722 | B2 | 4/2005 | Anderson et al. | |
| 7,100,646 | B2 | 9/2006 | Py et al. | |
| 7,263,411 | B2 | 8/2007 | Shows et al. | |
| 7,382,692 | B1 | 6/2008 | Hildebrandt | |
| 7,530,974 | B2 | 5/2009 | Domkowski et al. | |
| 7,621,273 | B2 | 11/2009 | Morton et al. | |
| 7,805,216 | B2 | 9/2010 | Shows et al. | |
| 8,002,130 | B2 | 8/2011 | Thilly | |
| 8,034,042 | B2 | 10/2011 | Domkowski et al. | |
| 8,042,714 | B2 | 10/2011 | Miyazaki et al. | |
| 8,090,471 | B2 | 1/2012 | Shows et al. | |
| 8,091,727 | B2 | 1/2012 | Domkowski | |
| 8,113,199 | B2 | 2/2012 | Augustyn et al. | |
| 8,122,923 | B2 | 2/2012 | Kraus et al. | |
| 8,123,736 | B2 | 2/2012 | Kraushaar et al. | |
| 8,157,784 | B2 | 4/2012 | Rogers | |
| 8,225,949 | B2 | 7/2012 | Aneas | |
| 8,303,572 | B2 | 11/2012 | Adair et al. | |
| 8,479,732 | B2 * | 7/2013 | Stuart | A61M 15/009 116/315 |
| 2002/0123736 | A1 * | 9/2002 | Fowles | A61J 1/1406 604/413 |
| 2003/0121878 | A1 | 7/2003 | Finneran | |
| 2004/0119203 | A1 | 6/2004 | Kierstead et al. | |
| 2004/0199139 | A1 | 10/2004 | Fowles et al. | |
| 2008/0003369 | A1 | 1/2008 | Uenishi et al. | |
| 2009/0050213 | A1 | 2/2009 | Biddell et al. | |
| 2009/0120934 | A1 | 5/2009 | Domkowski et al. | |
| 2009/0308496 | A1 | 12/2009 | Kawamata et al. | |
| 2009/0314291 | A1 | 12/2009 | Anderson et al. | |
| 2010/0059474 | A1 | 3/2010 | Brandenburger et al. | |
| 2010/0176080 | A1 | 7/2010 | Grunert et al. | |
| 2011/0144614 | A1 | 6/2011 | Hereford | |
| 2011/0147333 | A1 | 6/2011 | Grek et al. | |
| 2011/0253251 | A1 | 10/2011 | Mudd | |
| 2012/0000569 | A1 | 1/2012 | Wiegel | |
| 2012/0053555 | A1 * | 3/2012 | Ariagno | A61J 1/2089 604/413 |
| 2012/0116579 | A1 | 5/2012 | Shows et al. | |
| 2012/0123381 | A1 | 5/2012 | Kraus et al. | |
| 2012/0184938 | A1 | 7/2012 | Lev et al. | |
| 2012/0203193 | A1 | 8/2012 | Rogers | |
| 2013/0204201 | A1 | 8/2013 | Avery et al. | |
| 2013/0231630 | A1 | 9/2013 | Kraus et al. | |
| 2013/0253432 | A1 | 9/2013 | Avery et al. | |
| 2014/0163468 | A1 * | 6/2014 | Avery | A61J 1/16 604/111 |

FOREIGN PATENT DOCUMENTS

| | | | |
|---|---|---|---|
| EP | 0696994 | B1 | 12/1996 |
| EP | 0836465 | A1 | 4/1998 |
| EP | 0904763 | A2 | 3/1999 |
| EP | 0960616 | A2 | 12/1999 |
| EP | 1034772 | A1 | 9/2000 |
| EP | 1221924 | B1 | 3/2004 |
| EP | 1539577 | A2 | 6/2005 |
| EP | 1687203 | A2 | 8/2006 |
| EP | 1962932 | A2 | 9/2008 |
| EP | 1879642 | B1 | 7/2009 |
| EP | 2114345 | A1 | 11/2009 |
| EP | 2298406 | A1 | 11/2011 |
| EP | 2383199 | A1 | 11/2011 |
| EP | 2555814 | A1 | 2/2013 |
| EP | 2555815 | A1 | 2/2013 |
| EP | 2603260 | A1 | 6/2013 |
| EP | 1730676 | B1 | 8/2013 |
| FR | 2560049 | A1 | 8/1985 |
| FR | 2708204 | A1 | 2/1995 |
| JP | 236868 | A | 2/1990 |
| JP | 623052 | A | 2/1994 |
| JP | 2004534258 | A | 11/2004 |
| JP | 2008523930 | A | 7/2008 |
| JP | 2010538694 | A | 12/2010 |
| WO | 9400094 | A1 | 1/1994 |
| WO | 9507066 | A1 | 3/1995 |
| WO | 0152920 | A2 | 7/2001 |
| WO | 03007088 | A2 | 1/2003 |
| WO | 2004073775 | A1 | 9/2004 |
| WO | 2009035383 | A1 | 3/2009 |
| WO | 2011050333 | A1 | 4/2011 |
| WO | 2011072226 | A1 | 6/2011 |
| WO | 2012118923 | A2 | 9/2012 |

* cited by examiner

ADAPTOR FOR COUPLING WITH A MEDICAL CONTAINER

CROSS-REFERENCE TO RELATED APPLICATIONS

This application is a divisional application of U.S. application Ser. No. 14/375,203, filed Jul. 29, 2014, which is the United States national phase of International Application Serial No. PCT/SG2013/000042 filed Feb. 1, 2013, which claims priority to European Application Serial No. 12305958.6, filed on Aug. 2, 2012 and Singapore Application Serial No. 201200771-2, filed on Feb. 2, 2012, the entire disclosures of each of which are hereby incorporated by reference.

BACKGROUND OF THE INVENTION

Field of the Invention

The present invention relates to an adaptor for coupling to a medical container such as a vial containing a pharmaceutical product, such as a vaccine, said adaptor allowing for multiple aseptic needle piercing with an injection device to be filled with part of the product contained in the medical container.

Description of Related Art

In this application, the distal end of a component or apparatus must be understood as meaning the end furthest from the hand of the user and the proximal end must be understood as meaning the end closest to the hand of the user, with reference to the injection device intended to be used with said component or apparatus. As such, in this application, the distal direction must be understood as the direction of injection with reference to the injection device, and the proximal direction is the opposite direction, i.e. the direction of the transfer of the product from the vial to the injection device.

One of the ways to improve health is to immunize entire populations against a number of diseases. To date, injection administration is the most common method of administering vaccines.

Each year, numerous drugs, for example vaccines, need to be prepared throughout the world by healthcare institutions. Many vaccine compositions are usually not stable at room temperature and they must be stored at rather specific cold temperatures. Indeed, due to their biological nature, vaccines are complex to handle and to store. Vaccines are usually temperature sensitive and typically need to be maintained and stored at all time between 2 and 8 degrees Celsius (° C.). Some vaccines will be more sensitive to heat exposure and others will be sensitive to freezing. Therefore, maintaining and monitoring the appropriate temperatures during the storage and the handling of vaccines is a critical issue in order to sustain their efficacy. Overexposure to heat as well as overcooling may result in the destruction of the biological elements of the vaccines. Use of vaccines not stored in appropriate conditions may lead to not effective vaccination of the populations against diseases and would lead to expensive campaigns with limited results.

Furthermore, it is critical that the cold chain be not interrupted from production of the drug at a pharmaceutical company to its administration to the patient.

From a supply chain perspective, the most efficient vaccine packaging is the multidose container such as multidose vial, that is to say, vial that may contain up to 10, 100 or 1000 doses of vaccine, one dose being intended for one patient. These vials are usually closed by a septum. In preparation of an injection of a vaccine, the user pierces the septum of the vial with the needle of an empty syringe, he then fills the syringe with one dose of vaccine and proceeds to the injection of the vaccine to the patient.

As such, multidose vials imply that the septum of the vial be pierced successively a high number of times, namely as many as the number of doses present in the vial. In order to ensure safe injections, the sterility of the septum of the vial should be maintained during the whole time the vial is used.

Anyway, in locations where it is difficult to maintain favorable hygienic conditions such as remote locations which are far from towns and from hospital facilities, the multidose vials may be handled and manipulated at ambiant air. In such cases, the septum of the vial may be contaminated either by the ambiant air, or, each time a dose of vaccine is removed, by the needle of the empty syringe used.

In addition, in regions where there is limited or potentially no supply of energy to power cooling equipment such as a refrigerator, the multidose vials may be maintained in cold conditions by simple contact with ice packs. As time goes by, part of the ice may melt and turn into water, and the septum of the multidose vials may be in contact with such water that may contaminate the septum of the vial.

It may then happen that a multidose vial, such as for example a 10-dose vial, is opened and that only three doses are used, for vaccinating three patients only, the remaining content of the vial being wasted because not intended to be administered in a sufficiently short time after opening of the vial in order to guaranty the vaccine or drug sterility.

Vaccination campaigns can therefore be made difficult in some regions and a significant proportion of vaccines may be wasted by the time they reach their target. This has an unacceptable cost to the health organizations in charge of immunization campaigns. In addition, it may happen that in case of vaccination campaigns, or pandemic, hundreds of patients need to be vaccinated in a very short time, in locations where it is difficult to maintain favorable hygienic conditions such as remote locations which are far from towns and from hospital facilities.

Therefore, it would be desirable to provide a device that would allow several successive piercings of a multidose vial septum and that would guarranty that said piercings be carried out in aseptic conditions, in particular that the septum be made sterile at the time of injection act, or be maintained sterile during the lifetime of the multidose vial, and that would prevent wastage of the drug, even if the multidose vial is not stored or manipulated in aseptic conditions.

SUMMARY OF THE INVENTION

A first aspect of the present invention is an adaptor for coupling with a medical container having a collar closed by a septum, said septum having an outer surface directed towards the outside of the medical container, the adaptor comprising:

- a gripping member for securing the adaptor to the medical container, said gripping member being capable of being laterally mounted on the collar of said medical container,
- a pierceable elastomeric piece having at least a part intended to be in contact with the outer surface of the septum when said adaptor is secured on said medical container.

The adaptor of the invention is intended to be mounted on a medical container, such as for example a conventional vial for storing pharmaceutical products, such as multidose vials for vaccines. Such a vial 1 is shown on FIGS. 1A-1C and generally comprises a tubular barrel 2 having a longitudinal axis A, closed at an end and having a collar 3 at the opposite end, said collar 3 being closed by a septum 4. Usually, the septum 4 is fixedly attached to the collar 3 of the vial 1 by a peripheral band 5, said peripheral band 5 leaving a part of the septum 4, herein called outer surface 4*a* of the septum, directly facing the outside of the vial 1, namely the outside environment. The septum 4 is usually made of a material impermeable to gas and liquid and it seals hermetically the content of the vial 1. The septum 4 is also pierceable by the needle of an injection device intended to be filled with the product contained in the vial, said septum 4 being accessible to said needle via its outer surface 4*a*.

In the present application, "pierceable" means that the septum and the elastomeric piece of the adaptor may be pierced and traversed by the needle of an injection device such as a syringe, an auto-injector, or a reconstitution device, for example for administering a pharmaceutical product such as a drug or a vaccine.

The gripping member of the adaptor of the invention may be any member capable of securing the adaptor around on the medical container, and in particular around the collar of the medical container, either in a temporary or permanent way.

The pierceable elastomeric piece of the adaptor of the invention has at least a part intended to be in contact with the outer surface of the septum when said adaptor is secured on said medical container: in other words, the elastomeric piece has a design, shape, and location on the adaptor, allowing a part of it to be in contact, in particular in close contact, with the outer surface of the septum when said adaptor is secured on said medical container.

The adaptor of the invention allows piercing the septum of the medical container in favorable hygienic conditions multiple successive times. Indeed, when the user decides to fill in an empty syringe with a dose of drug contained in the medical container, he simply secures the adaptor of the invention on the medical container by means of the gripping member. Once the adaptor is secured on the medical container, the pierceable elastomeric piece of the adaptor is in contact, for example in tight contact, with the outer surface of the septum of the medical container. As a consequence, introducing the needle in the medical container implies that the needle pierces and traverses the elastomeric piece of the adaptor in the first place. During this step, the needle mechanically rubs against the material forming the elastomeric piece and it is naturally cleaned, as the potential bacteria are wiped out from the needle when said needle penetrates the elastomeric piece. In addition, once the needle protrudes out of the elastomeric piece of the adaptor, it directly enters the septum of the medical container and may therefore not be contaminated by foreign elements. Indeed, since at least a part of the pierceable elastomeric piece is in contact with the outer face of the septum when the adaptor is secured on the medical container, the needle is not in contact with ambient air when it successively penetrates the pierceable elastomeric piece and then the septum.

The user may repeat the piercing step with the needle of a new empty injection device until all the doses contained in the medical container are removed. The adaptor of the invention acts as a protection of the septum.

In embodiments, the elastomeric piece is made of a gas and liquid impermeable material capable of flexing under pressure. For example, the elastomeric piece has a thickness ranging from 1 to 8 mm, preferably from 2 to 4 mm. The elastomeric piece may show a hardness ranging from 10 to 100 Shore A, preferably from 40 to 70 Shore A, measured according to standard DIN 53505.

Suitable materials for the pierceable elastomeric piece of the adaptor of the invention include natural rubber, acrylate-butadiene rubber, cis-polybutadiene, chloro or bromobutyl rubber, chlorinated polyethylene elastomers, polyalkylene oxide polymers, ethylene vinyl acetate, fluorosilicone rubbers, hexafluoropropylene-vinylidene fluoride-tetrafluoroethylene terpolymers, butyl rubbers, polyisobutene, synthetic polyisoprene rubber, silicone rubbers, styrene-butadiene rubbers, tetrafluoroethylene propylene copolymers, thermoplastic-copolyesters, thermo-plastic elastomers, or the like or a combination thereof.

In embodiments, the pierceable elastomeric piece is self-resealing. "Self-resealing" means in the present application that the elastomeric piece closes automatically and rapidly the hole produced by the piercing of the needle, for example in less than 0.5 seconds, once the needle is removed from the elastomeric piece. This automatic closure step may occur a high number of times, for example as many times as necessary for removing the numerous doses of products contained in the multidose medical container. This automatic obstruction restricts or prevents air and/or contaminants from entering inside the medical container, as well as at the interface between the elastomeric piece and the septum, and thus allows asepsis maintenance. Moreover, the presence of the pierceable elastomeric piece of the adaptor of the invention gives time to the septum of the medical container to reseal, as the needle is still present in the pierceable elastomeric piece after it is removed from the septum. As such, neither air nor contaminants may be introduced in the medical container or at the interface between the elastomeric piece and the septum, even if the medical container is maintained under negative pressure after the withdrawing of one or more doses of product. In addition, the septum of the medical container may itself be self-resealing.

Suitable materials for self-resealing pierceable elastomeric piece of the adaptor of the invention include synthetic polyisoprene, natural rubber, silicone rubber, thermo-plastic elastomers, or the like or a combination thereof.

In embodiments, the pierceable elastomeric piece may further comprise a material including antiseptic agents, such as silver ions or copper ions. For example, silver salts or copper salts may be covalently linked to a polymer matrix of the pierceable elastomeric piece. Alternatively, silver salts or copper salts may be included as a load during the manufacturing of the polymer present in the material comprised in the pierceable elastomeric piece. For example, the polymer matrix may be selected from silicone rubber, butyl rubber and/or halogenobutyl rubber. In embodiments, the pierceable elastomeric piece may be made in silicone rubber including silver ions: such products are commercially available from the company Momentive Performance Materials under the tradenames "Statsil®" or "Addisil®". In embodiments, the pierceable elastomeric piece may consist in a silicone rubber including silver ions.

Pierceable elastomeric pieces of the adaptor of the invention, comprising a material including antiseptic agents, such as silver ions or copper ions, show antiseptic properties. The growth of bacteria at the surface of the pierceable elastomeric piece is therefore directly prevented. These materials also show hydrophobic properties which prevent condensation formation, thereby further reducing growth of bacteria.

As a consequence, when a needle pierces a pierceable elastomeric piece of the adaptor of the invention comprising a material including antiseptic agents, before entering a vial for withdrawing a dose of product from said vial, the risk of contamination of the vial content is highly reduced.

Alternatively or in combination, the pierceable elastomeric piece may comprise a coating comprising an antiseptic agent, such as chlorhexidine di-acetate. For example, the pierceable elastomeric piece may comprise a butyl rubber or a halogenobutyl rubber coated with a coating comprising chlorhexidine di-acetate. For example, a solution of chlorhexidine di-acetate may be applied on the pierceable elastomeric piece before being submitted to UV cross-linking. Such kind of coatings are very interesting as they have fast kinetic (within minutes) and therefore can clean a needle during its insertion within the pierceable elastomeric piece.

In embodiments, the surface of said part of the pierceable elastomeric piece is complementary to the whole outer surface of the septum. As such, whatever the piercing location of the pierceable elastomeric piece of the adaptor by the needle, the user is ensured that the distal tip of the needle will directly pierce the septum after being passed through the pierceable elastomeric piece. Therefore, said distal tip is not in contact with ambient air or with other elements that would be trapped between the outer surface of the septum and the surface of the pierceable elastomeric piece. In particular, in such embodiments, the outer surface of the septum and the complementary surface of the pierceable elastomeric piece match each other in such a way that they are in intimate contact together on their entire surface and lead to a closed interface.

In embodiments, the adaptor further comprises a compressive member for pressing said pierceable elastomeric piece onto said outer surface of the septum, when said adaptor is secured on said medical container, said compressive member being capable to transition from an inactive state, in which it does not exert pressure on said pierceable elastomeric piece, to an active state, in which it exerts pressure. For example, an initial distal pressure on the compressive member may be exerted by the user at the time he mounts the adaptor on the medical container, in particular in order to make the compressive member transition from its inactive state to its active state. Once in its active state, the compressive member exerts a pressure on the pierceable elastomeric piece, even after the user has released his initial distal pressure on the compressive member. Such embodiments ensure that the outer surface of the septum and the complementary surface of the pierceable elastomeric piece are in tight contact together and that no ambient air is trapped between the outer surface of the septum and the complementary surface of the pierceable elastomeric piece. The distal tip of the needle may not enter in contact with other elements than the pierceable elastomeric piece and the septum when it successively traverses the pierceable elastomeric piece and the septum. Furthermore, the interface between the septum and the pierceable elastomeric piece is now sealed:no ambient air can be sucked into the medical container when the needle is removed from the pierceable elastomeric piece and the medical container septum.

In embodiments, the adaptor further comprises a fixing system for preventing releasing of said gripping member and definitively securing the adaptor on said medical container. Such embodiments ensure that the adaptor is not separated from the medical container and prevent any re-use of the adaptor on another medical container. The favorable hygienic conditions of the medical container are therefore maintained.

In embodiments, the adaptor further comprises a transversal wall connected to said gripping member, said transversal wall having a hole in which is lodged said pierceable elastomeric piece. For example, the gripping member and the transversal wall may be formed of one single piece. In embodiments, the transversal wall is proximally deflectable. For example, the transversal wall may be proximally deflected by the collar of the medical container when the adaptor is mounted on the medical container, the transversal wall coming back to a non deflected position once the adaptor is correctly fitted on the collar of the medical container. In particular, the proximally deflectable transversal wall may be made of a flexible or semi-rigid material so that the transversal wall comes back automatically to its non deflected position once the adaptor is correctly fitted on the collar of the medical container. In such a case, the proximally deflectable transversal wall also acts as the compressive member and is capable to transition from an inactive state, namely in its deflected position, in which it does not exert pressure on said pierceable elastomeric piece, to an active state, where it is back to its non-deflected position, in which it exerts pressure on said pierceable elastomeric piece.

In embodiments, the gripping member is provided with a plurality of first recesses with sloped distal faces and of second recesses, and the compressive member is provided with inner radial pegs, said inner radial pegs being engageable with said first recesses and/or second recesses.

For example, the gripping member may be a lateral clipping member comprising a U-shaped element intended to be engaged on said collar via the open part of the U-shaped element, the curved part of the U-shaped element partially surrounding the collar. For example, the transversal wall may join together the two branches of the U of the U-shaped element.

In other embodiments, the gripping member is an axial clipping member capable of being axially mounted on the collar of said medical container. For example, the axial clipping member may comprise a tubular element capable of being axially engaged on said collar. For example, the transversal wall may then be a disk wall contained within the tubular element.

In embodiments, the lateral clipping member is adapted to receive large diameter vials, with a collar having typically a diameter of 20 mm, and is therefore not compatible with small diameter vials having typically a collar with a diameter of 13 mm. Therefore, a vial collar ring may be provided to be used with small diameter vials in order to fit with the adaptor of the present invention. For example, such vial collar ring is provided with two cylindrical portions: a top portion with a large diameter to enclose the vial septum and the peripheral band, and a bottom portion with a small diameter to enclose the vial collar. This vial collar ring may consist in two hemi-rings connected together for example by a hinge that can be plugged to each other on their free extremity by a snap-in lock. The snap-in lock may comprise a snap-in portion on the first ring and a recess on the second ring. With this snap-in lock, the vial collar ring can either be provided in an open state or in a closed state. The vial collar ring can be plugged onto a small diameter vial. Then, the adaptor of the present invention can be mounted on the small diameter vial having such vial collar ring.

In embodiments, the adaptor further comprises a cleaning pad, said cleaning pad being configured to at least partially slide on said outer surface of said septum when the adaptor is being mounted on the medical container. Such embodiments allow the outer surface of the septum, where the distal tip of the needle is intended to penetrate, to be automatically cleaned before the adaptor is secured to the medical container.

The cleaning pad may be any pad, such as fabric or sponge, for example out of cotton or any other porous material, and may be treated by a cleaning solution. For example, the cleaning pad may comprise a disinfecting agent. The outer surface of the septum is therefore disinfected before the elastomeric piece of the adaptor comes in contact with it. The disinfecting agents may be selected from alcohols, such as ethanol or isopropanol, organic solvents, such as nitrofurane, toluene, phenol and derivatives thereof, derivatives of quinoline and acridine, salts such as sodium hypochlorite, sodium chlorite or sodium chlorate, chlorine dioxide, salts of iodine, mercury, silver, ammonium, or the like, or a combination thereof. For example, the disinfecting agent may be selected according to the most common bacteria and viruses that may be found in the area of use of the medical container.

In particular, the cleaning pad may be provided as a part of the adaptor, for example as a part of the transversal wall. The user has no additional operation or action to do than simply mounting the adaptor on the vial. Because of the location and configuration of the cleaning pad on the adaptor, the cleaning pad automatically slides on the outer surface of the septum, thereby wiping out potential bacteria or contamination agents present on said outer surface, when the user completes the step of mounting the adaptor on the collar of the vial.

For example, in embodiments where the lateral clipping member comprises a U-shaped element intended to be engaged on said collar via the open part of the U, the curved part of the U partially surrounding the collar, said transversal wall may be provided in the direction of the free ends of the U-shaped element, with a projection provided with said cleaning pad. For example, the cleaning pad is located on the distal face of the projection. As such, when the user approaches the free ends of the U of the lateral clipping member towards the collar of the vial, the cleaning pad enters in contact with an edge of the outer surface of the septum. While the user continues to move the lateral clipping member towards the collar so as to mount it thereon, the cleaning pad slides on the outer surface of the septum, until it loses contact with said septum when the lateral clipping member reaches its position where it is secured on the collar. In this position, because of its location at the free ends of the U, the cleaning pad does not face the septum anymore and it does not prevent the piercing of the septum by the needle to take place. During the mounting step of the adaptor on the collar as described above, the sliding of the cleaning pad onto the outer surface of the septum has wiped out the bacteria and/or contamination elements potentially present on said outer surface. The outer surface of the septum is therefore decontaminated when the elastomeric piece of the adaptor comes in contact with it.

In embodiments where the axial clipping member comprises a tubular element capable of being axially engaged on said collar, said transversal wall being located within said tubular element, the cleaning pad may be a breakable membrane attached to the inner wall of said tubular element, and located distally with respect to said transversal wall. As such, when the user approaches the distal free end of the tubular element of the axial clipping member towards the collar of the vial, the breakable membrane enters in contact with the outer surface of the septum. While the user continues to move the axial clipping member distally so as to mount it on the collar of the vial, the breakable membrane, which is attached to the inner wall of the tubular element, becomes stretched out on the outer surface of the septum and finally breaks on said outer surface and is torn in several parts that slide on said outer surface while the axial clipping member reaches its position where it is secured on the collar. In this position, because it is now torn in several parts hanging along the inner walls of the tubular element, the membrane does not face the septum anymore and it does not prevent the piercing of the septum by the needle to take place. During the mounting step of the adaptor on the collar as described above, the sliding of the several torn parts of the breakable membrane on the outer surface of the septum has wiped out the bacteria and/or contamination elements potentially present on said outer surface. The outer surface of the septum is therefore decontaminated when the elastomeric piece of the adaptor comes in contact with it.

In embodiments, the cleaning pad is located on a removable part of said adaptor. For example, said removable part may be removed from said adaptor once said adaptor is secured on said medical container. Such embodiments allow extensive cleaning by healthcare workers of the medical container septum and/or of other surfaces such as the injector needle or the patient's skin, as well as prompt disposal of the cleaning pad after use, or may allow avoiding contamination with a harmful disinfecting agent.

In embodiments, a tubular lodging extends from said transversal wall in the proximal direction, said tubular lodging being shaped and dimensioned for receiving an injection device. For example, the tubular lodging may be capable of receiving an empty injection device to be filled with a dose of the drug contained in the medical container. In embodiments, a cavity filled with decontaminated atmosphere is provided in the tubular lodging, the needle of the injection device or syringe received in said tubular lodging being lodged in said cavity. Such embodiments allow better hygienic conditions for proceeding to the piercing of the outer surface of the septum of the medical container.

In embodiments, the removable part on which the cleaning pad is located is a portion of a blister surrounding said adaptor in a storage state. For example, said portion of said blister may remain on the adaptor while the adaptor is mounted on the collar and may be removed thereafter, once the cleaning pad has completed its function of decontaminating the outer surface of the septum. In embodiments, the blister is provided with front guiding projection.

In embodiments, the adaptor further comprises an air inlet for allowing air entrance into the medical container, once the adaptor is secured on said medical container. Such embodiments are advantageous in the case the medical container is made of glass or polymeric materials the walls of which are not collapsible. The presence of an air inlet prevents the formation of vacuum in the medical container when the medical fluid is withdrawn therefrom. For example, the air inlet comprises a cannula extending from the adaptor in the distal direction and provided with a sharp distal tip, capable of piercing the septum of the medical container, the proximal end of the cannula protruding outside the adaptor in ambient atmosphere. In embodiments, the air inlet is provided with a filter to restrict, in embodiments to prevent, entry of particulates or bacteria from the ambient atmosphere into the medical container, in particular during the vaccine withdrawal process. For example, this filter has a pore size of approximately 0.22 microns. This filter may also be provided with silver antimicrobial additive in order to obtain a supplementary protection of the vial sterility. Alternatively or in addition, this filter may be provided with a chlorhexidine coating. Such a filter is commercially available from Porex® under the tradename Barrier Technology™.

In embodiments, the adaptor further comprises a pierceable decontamination insert located proximally with respect to said elastomeric piece. In such embodiments, the distal tip of the needle therefore first pierces the decontamination insert, in which it is decontaminated, then the pierceable elastomeric piece, in which it is submitted to a mechanical cleaning as explained above, before entering in contact with the outer surface of the septum of the vial. For example, the pierceable decontamination insert may be a sterilizing gel.

In embodiments, the adaptor further comprises a counting system. Such embodiments allow the user to be provided with information about how many doses of product have already been withdrawn from the medical container or how many doses of product remain in the medical container. For example, the counting system may be manually actionable.

In embodiments, the adaptor is further provided with a time monitoring system. A time monitoring system allows monitoring the elapsing time from the first dose withdrawal. A time monitoring system may also indicate to the user what is the time remaining before a determined deadline, such for example a 28 or 30 days deadline.

In embodiments where a blister surrounds said adaptor in a storage state, the time monitoring system is capable of being triggered once the adaptor is mounted on the collar of the drug container, by a peg of the blister coming in contact with the time monitoring system when a user applies a distal pressure on a shell of the blister.

Another aspect of the invention is an assembly comprising a medical container having a collar closed by a septum, said septum having an outer surface directed towards the outside of the medical container, and an adaptor as described above. In embodiments, the septum is self-resealing.

DESCRIPTION OF THE INVENTION

Figure 1A:
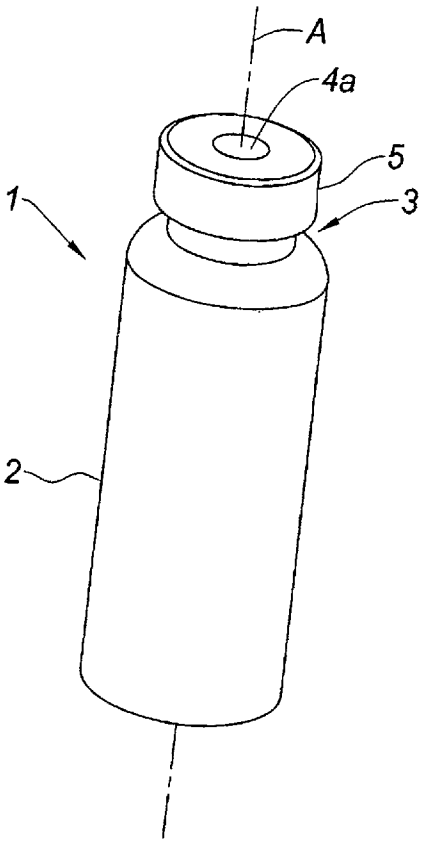
FIGS. 1A-1C are respectively a perspective view, a partial side view and a partial cross section view of a conventional vial on which the adaptor of the invention is to be mounted.
Figure 1B:
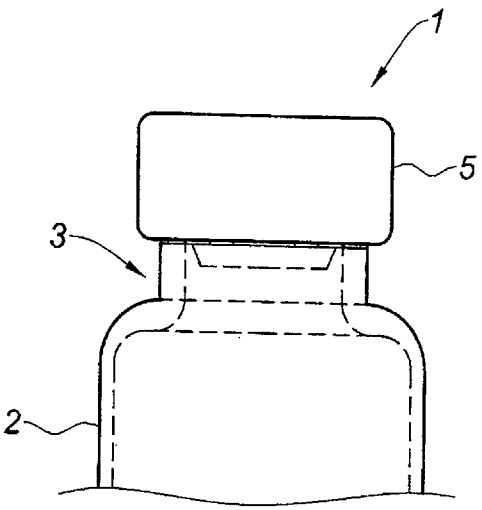
Figure 1C:
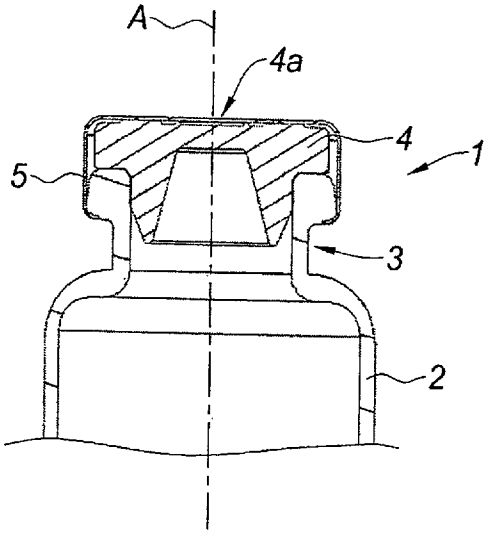
Figure 2A:
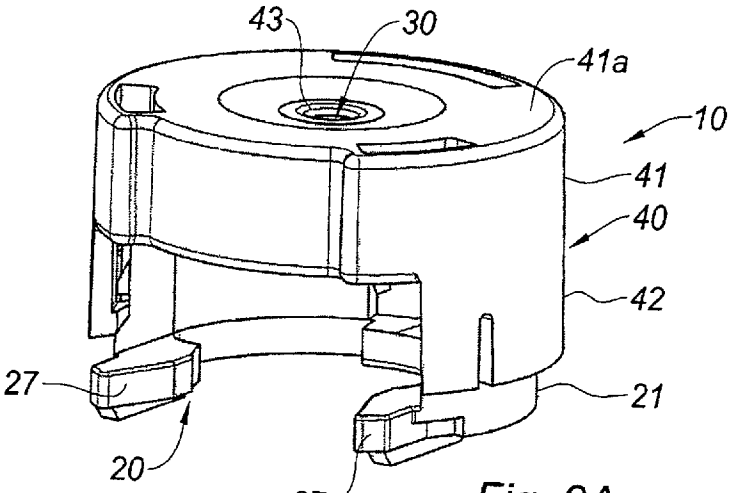
FIGS. 2A-2B are perspective views of an adaptor in accordance with an embodiment of the invention, respectively from the top front and from the bottom front, in a position for being mounted on the collar of a vial.
Figure 2B:
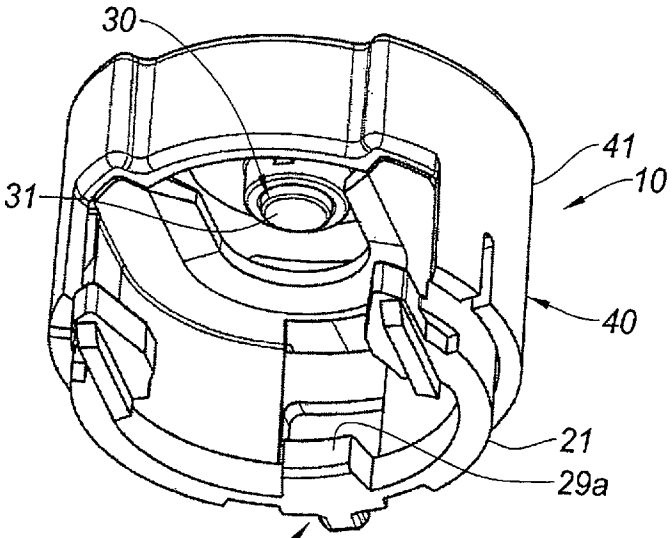
Figure 2C:
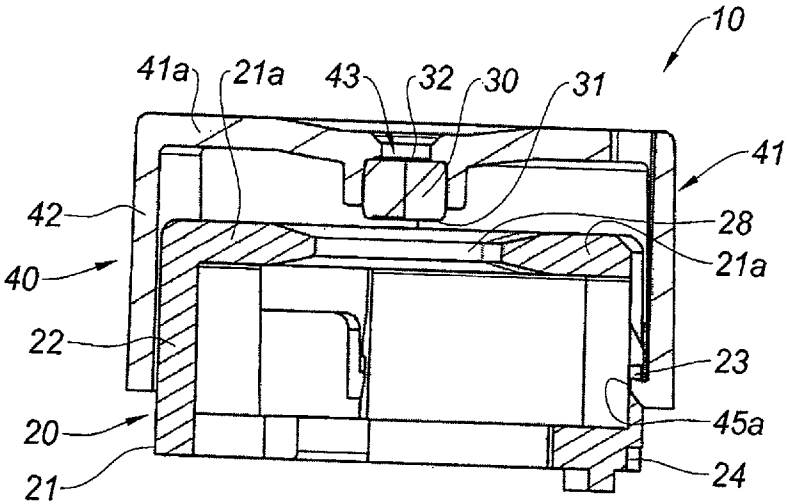
FIG. 2C is a cross section view of the adaptor of FIGS. 2A-2B, FIGS. 3A-3C are perspective views of the gripping member of the adaptor of FIGS. 2A-2C, respectively from the top front, from the bottom front and from the rear.
Figure 3C:
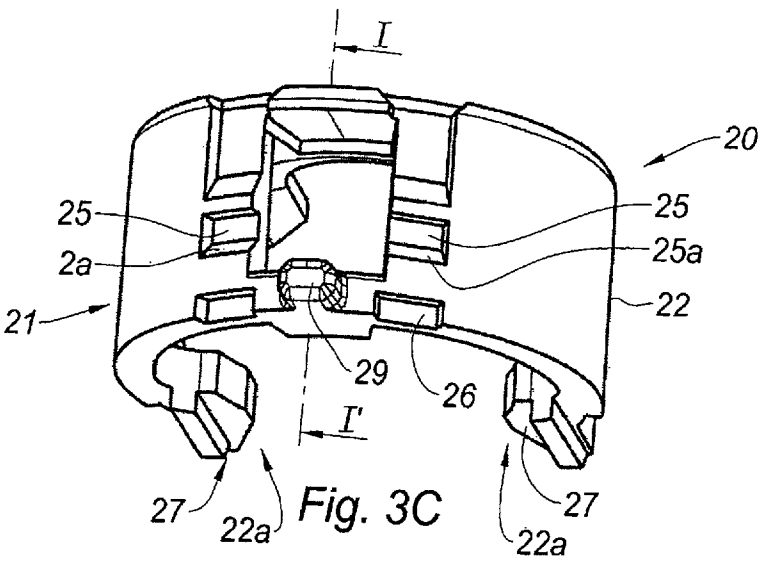
FIG. 3D is a cross section view of the gripping member of FIG. 3C along line I-I'.
Figure 3D:
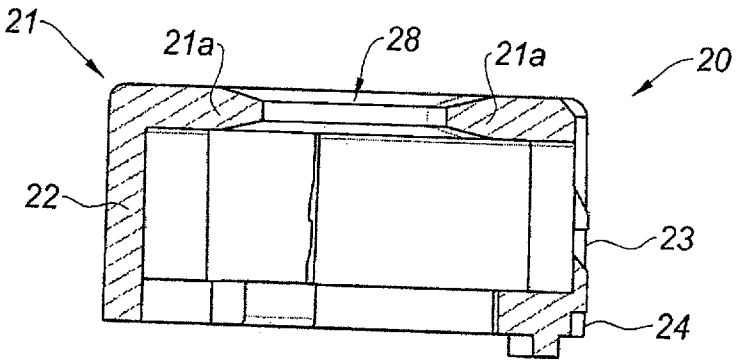
Figure 3A:
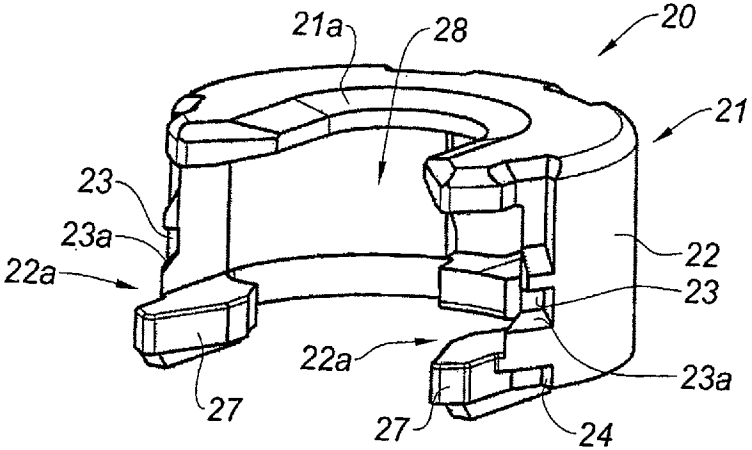
Figure 3B:
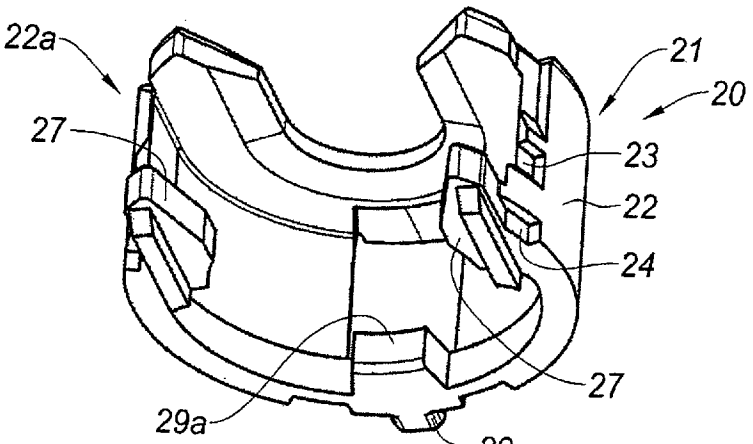

With reference to FIGS. 2A-2C is shown an adaptor 10 in accordance with an embodiment of the invention, in a position for being mounted on a multidose vial 1 as shown on FIGS. 1A-1C. The adaptor 10 comprises a gripping member 20 intended to secure it onto the vial 1, and an elastomeric piece 30 which is pierceable by the needle of an injection device. The adaptor 10 also comprises a compressive member 40, for pressing the elastomeric piece 30 onto the outer surface 4*a* of the septum 4, when the adaptor 10 is secured on the vial 1. As will be shown from the description below, the compressive member 40 is capable to transition from an inactive state, in which it does not exert any pressure on the elastomeric piece 30, to an active state, in which it exerts such a pressure. In the embodiment shown, parts of the gripping member 20 and of the compressive member 40 are also useful in combination for forming a fixing system for preventing the release of the gripping member 20 and definitively securing the adaptor 10 on the vial 10, as will be explained below.

With reference to FIGS. 3A-3D, the gripping member 20 will now be described in detail. The gripping member 20 is a lateral gripping member and comprises a U-shaped body 21, having a partially tubular wall 22 showing a height suitable for surrounding the collar 3 of the vial 1 (see FIGS. 9A-B), with two free ends 22*a* corresponding to the ends of the branches of the U, the U-shaped body 21 therefore forming a clipping member. Close to each free end 22*a*, the tubular wall 22 is provided on its outer surface with a first recess 23, and with a second recess 24, distally spaced with respect to the first recess 23. First recesses 23 are provided with sloped distal faces 23*a*. In its circular portion, the partially tubular wall 22 is further provided on its outer surface with a pair of first rear recesses 25, and with a pair of second rear recesses 26, distally spaced with respect to the pair of first rear recesses 25. First rear recesses 25 are provided with sloped distal faces 25*a*. Still in its circular portion, the partially tubular wall 22 is further provided on its outer surface with a rear projection 29 located between the two second rear recesses 26, and on its inner surface with a forward projection 29*a*.

Each free end 22*a* is further provided with a distal front projection forming a radial rim 27.

The U-shaped body 21 is further provided at its proximal end with an inner annular rim 21*a*, forming a central hole 28.

Figure 4B:
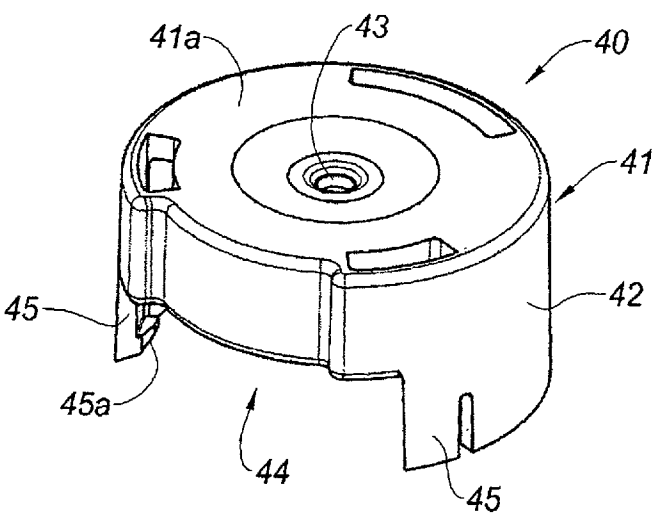
FIGS. 4A and 4B are perspective views of the compressive member of the adaptor of FIGS. 2A-2C, respectively from the bottom front and from the top front.
Figure 4A:
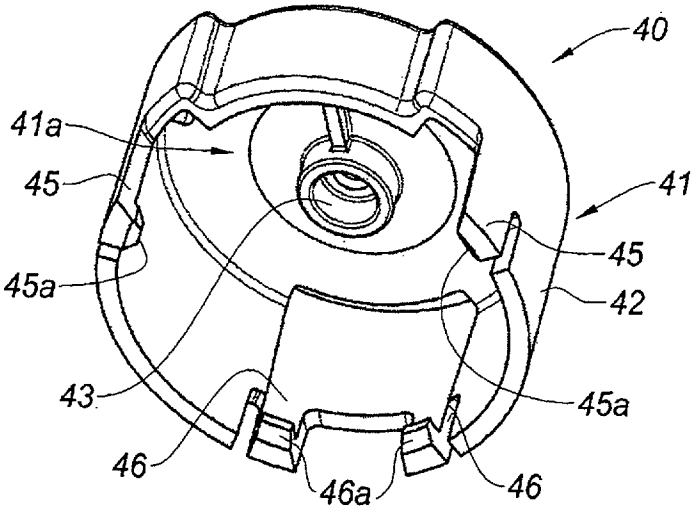

With reference to FIGS. 4A and 4B, the compressive member 40 will now be described in detail. The compressive member 40 comprises a cap 41, formed of a tubular wall 42 closed at its proximal end by a transversal wall 41*a*. The cap 41 is sized and shape for receiving therein the gripping member 20. The transversal wall 41*a* is provided with a central hole 43 for receiving the elastomeric piece 30 (see FIG. 2B). The tubular wall 42 is provided with an opening 44 on a part of its circumference, herein called "front part" of the compressive member 40, said opening 44 being intended to face and receive the free ends 22*a* of the gripping member 20 when the gripping member 20 and the compressive member 40 are assembled together to form the adaptor of FIGS. 2A-2D.

In its front part, on each side of the opening 44, the tubular wall 42 is provided with a flexible leg 45 having a distal free end having an inner radial peg 45*a*. In its rear part opposite its front part, the tubular wall 42 is provided with two rear flexible legs 46 having a distal free end having an inner radial peg 46*a* (see FIG. 4A).

Figure 5:
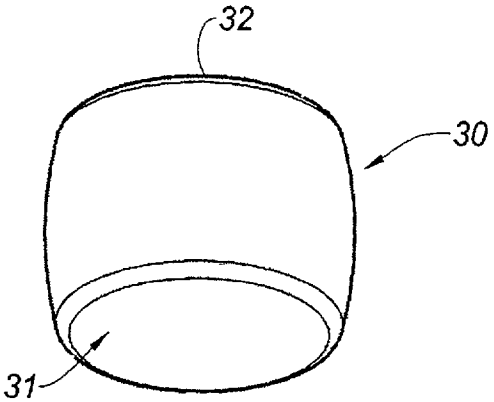
FIG. 5 is a perspective view of the elastomeric piece of the adaptor of FIGS. 2A-2C, FIGS. 6A-6B are perspective views of the adaptor of FIGS. 2A-2C, respectively from the top front and from the bottom front, in a position where it is definitely secured on the collar of a vial (not shown)
Figure 6A:
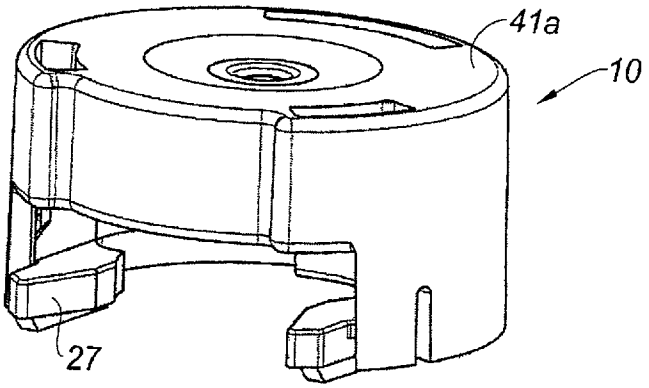
FIG. 6C is a cross section view of the adaptor of FIGS. 6A-6B.
Figure 6B:
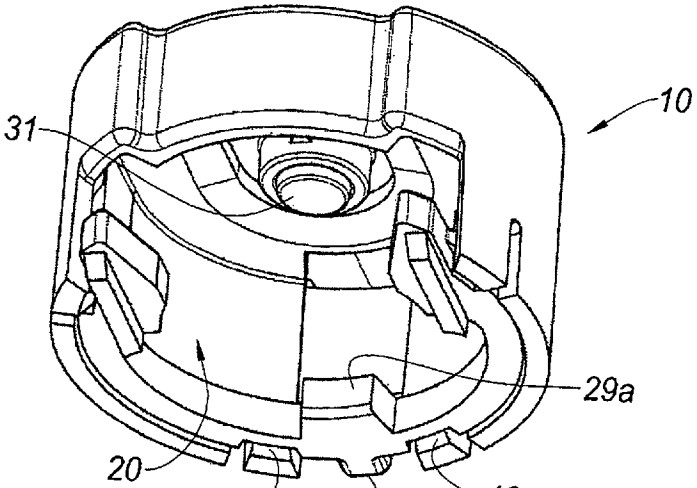
Figure 6C:
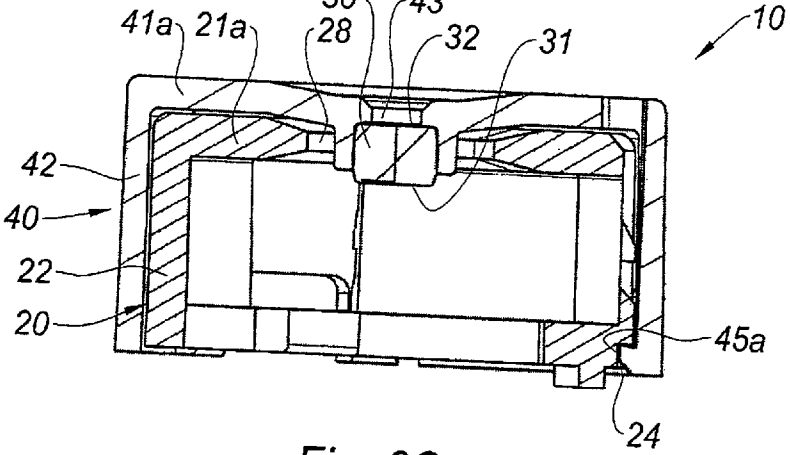

On FIG. 5 is shown the pierceable elastomeric piece 30. In the embodiment shown, the pierceable elastomeric piece 30 has globally the shape of a flat cylinder. As shown on FIGS. 2A-D and 6A-D, the pierceable elastomeric piece 30 is dimensioned and shaped so as to be received within central hole 43 of the transversal wall 41*a* of the cap 41 with friction. As also shown from these Figures, the distal face of the pierceable elastomeric piece 30 has a plane surface 31 having a rounded shape. In embodiments not shown, the pierceable elastomeric piece may have any suitable shape complementary to that of the central hole of the transversal wall, such as a cubic shape, etc.

The pierceable elastomeric piece 30 is made of a material impermeable to gas and liquid capable of flexing under pressure. For example, the elastomeric piece has a thickness ranging from 1 to 8 mm, preferably from 2 to 4 mm. The elastomeric piece may show a hardness ranging from 10 to 100 Shore A, preferably from 40 to 70 Shore A, measured according to DIN 53505.

Suitable materials for the pierceable elastomeric piece 30 of the adaptor of the invention include natural rubber, acrylate-butadiene rubber, cis-polybutadiene, chloro or bromobutyl rubber, chlorinated polyethylene elastomers, polyalkylene oxide polymers, ethylene vinyl acetate, fluorosilicone rubbers, hexafluoropropylene-vinylidene fluoride-tetrafluoroethylene terpolymers, butyl rubbers, polyisobutene, synthetic polyisoprene rubber, silicone rubbers, styrene-butadiene rubbers, tetrafluoroethylene propylene copolymers, thermoplastic-copolyesters, thermo-plastic elastomers, or the like or a combination thereof.

Preferably, the elastomeric piece is self-resealing and it automatically seals the hole produced by the piercing of the needle, automatically and rapidly, for example in less than 0.5 seconds, once the needle is removed from the elastomeric piece. This automatic closure step may occur a high number of times, in particular as many times as necessary for removing the numerous doses of product initially present in the multidose vial 1. Suitable materials for self-resealing pierceable elastomeric piece of the adaptor of the invention include synthetic polyisoprene, natural rubber, silicone rubber, thermo-plastic elastomers, or the like or a combination thereof.

In embodiments, the pierceable elastomeric piece may further comprise a material including antiseptic agents, such as silver ions or copper ions. For example, silver salt or copper salt may be covalently linked to a polymer matrix present in the material comprised in the pierceable elastomeric piece. Alternatively, silver salts or copper salts may be introduced as a load during the manufacturing of the polymer present in the material comprised in the pierceable elastomeric piece. For example, the polymer matrix may be selected from silicone rubber, butyl rubber and/or halogenobutyl rubber. In embodiments, the perceable elastomeric piece comprises a material comprising a silicone rubber including silver ions: such products are commercially available from the company Momentive Performance Materials under the tradenames "Statsil®" or "Addisil®". In embodiments, the pierceable elastomeric piece may consist in a material including silver ions, such as silicone rubber including silver ions. In other embodiments, the pierceable elastomeric piece may consist in a material including copper ions.

Pierceable elastomeric pieces of the adaptor of the invention, comprising a material including antiseptic agents, such as silver ions or copper ions, show antiseptic and hydrophobic properties. The growth of bacteria is therefore directly prevented at the surface of the pierceable elastomeric piece. Moisture formation is also prevented, thereby further reducing the growth of bacteria. As a consequence, when a needle pierces a pierceable elastomeric piece of the adaptor of the invention comprising a material including antiseptic agents, such as silver ions or copper ions, in view of entering a vial for removing a dose of product from said vial, the risk of contamination of the vial content is reduced.

Alternatively or in combination, the pierceable elastomeric piece may comprise a coating comprising an antiseptic agent, such as chlorhexidine di-acetate. For example, the pierceable elastomeric piece may comprise a butyl rubber or a halogenobutyl rubber coated with a coating comprising chlorhexidine di-acetate. Such a coating may be obtained by UV cross-linking. The antiseptic action of such a coating may occur within minutes and such a coating may therefore be able to clean a contaminated needle during its insertion within the pierceable elastomeric piece.

For example, a solution of chlorhexidine di-acetate may be applied on the pierceable elastomeric piece before being submitted to UV cross-linking. Such kind of coatings are very interesting as they have fast kinetic (within minutes)

and therefore can clean a needle during its insertion within the pierceable elastomeric piece.

The use of the adaptor 10 in connection with a vial of FIGS. 1A-1C will now be explained with reference to FIGS. 2A-10B.

Figures 7, 8:
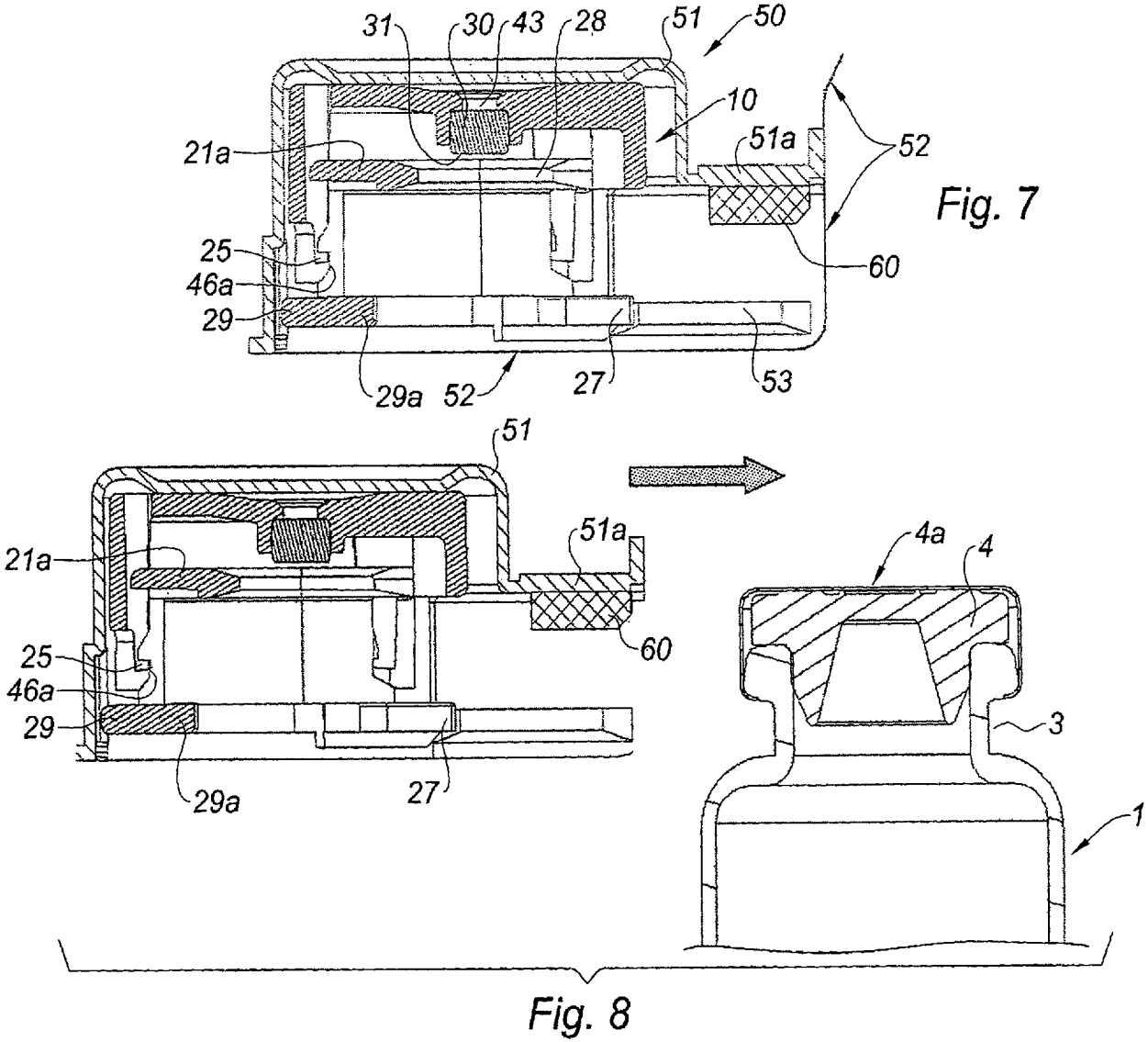
FIG. 7 is a cross section view of the adaptor of FIG. 2C packed in a closed blister in a storage position.
FIG. 8 is a cross section view of the adaptor of FIG. 7 with the blister open, and of the proximal region of the vial onto which the adaptor is to be secured.

The adaptor 10 is provided to the user with the gripping member 20, the pierceable elastomeric piece 30 and the compressive member 40 assembled together in the inactive state of the compressive member 40 as shown on FIGS. 2A-2C, and packed in a blister 50 as shown on FIG. 7.

With reference to FIGS. 2A-2C, the pierceable elastomeric piece 30 is lodged in the central hole 43 of the cap 41 in which it remains fixed by friction, with its plane and rounded distal face 31 protruding distally outside said central hole 43, and its proximal face 32 protruding proximally outside the central hole 43. The cap 41 is assembled on the U-shaped body 21 by means of inner radial pegs 46*a* (FIG. 4A) being engaged in first rear recesses 25, and of inner radial pegs 45*a* being engaged in first recesses 23. In this position, the opening 44 of the tubular wall 42 faces the free ends 22*a* of the tubular wall 22 of the U-shaped element 21, and the central hole 43 with the elastomeric piece 30 faces the central hole 28 of the gripping member 20.

With reference to FIG. 7, the adaptor 10 is packed before use in a blister 50 surrounding the adaptor 10. The blister 50 comprises a shell 51 closed by a pellicle film 52. The shell 51 is provided with a front projection 51*a* carrying a cleaning pad 60, and with front guiding projections 53 located distally with respect to said front projection 51*a*.

The cleaning pad 60 may be any pad, such as fabric or sponge, for example out of cotton or any other porous material, and may be imbibed with a cleaning solution or disinfecting composition. For example, the cleaning pad 60 may comprise a disinfecting agent. The disinfecting agents may be selected from alcohols, such as ethanol or isopropanol, organic solvents, such as nitrofurane, toluene, phenol and derivatives thereof, derivatives of quinoline and acridine, salts such as sodium hypochlorite, sodium chlorite or sodium chlorate, chlorine dioxide, salts of iodine, mercury, silver, ammonium, or the like, or a combination thereof.

Once the user is ready to proceed to the withdrawal of a dose of product contained in the vial 1, he removes the pellicle film 52 in order to open the blister 50. In the embodiment shown, the shell 51 remains on the adaptor 10 until the adaptor 10 is secured on the collar 3 of the vial 1. The shell 51 is removed thereafter, before piercing of the elastomeric piece 30 by the needle of the injection device. In other embodiments, the whole blister 50 may be removed before mounting the adaptor 10 on the vial 1.

With reference to FIG. 8, the user then approaches the front part of the adaptor 10 with the shell 51 towards the collar 3 of vial 1, in order to mount laterally the adaptor 10 onto the collar 3 of the vial 1. The front guiding projections 53 of the shell 51 slide around the collar 3 so as to guide the adaptor 10 and ensure appropriate positioning and correct fitting of the gripping member 20 on the collar 3 of the vial 1. The cleaning pad 60 enters first in contact with an edge of the outer surface 4*a* of the septum 4. While the user continues to move laterally the shell 51 containing the adaptor 10, and thus the lateral clipping member 20 towards the collar 3 so as to mount it thereon, the cleaning pad 60 slides on the outer surface 4*a* of the septum 4, until it loses contact with said septum 4 when the clipping member 20 reaches its position where it is secured on the collar 3, by means of forward projection 29*a* and radial rims 27 surrounding the collar 3, as shown on FIG. 9A.

During the mounting step of the adaptor 10 on the collar 3 as described above, the sliding of the cleaning pad 60 onto the outer surface 4*a* of the septum 4 has wiped out bacteria and/or contamination elements potentially present on said outer surface 4*a*. The outer surface 4*a* of the septum 4 is therefore decontaminated when the elastomeric piece 30 of the adaptor 10 comes in contact with it.

Moreover, the lateral mounting of the clipping member 20 allows a compressive and precise positioning of the adaptor 10 onto the vial collar 3. The connection of the adaptor 10 on the vial 1 is straightforward for the user and can be performed easily, even with a single hand.

In another embodiment (not shown), where the blister 50 is fully removed before mounting the adaptor 10 on the vial 1, the cleaning pad 60 is provided on a proximal front projection of a free end 22*a*, for example opposite the radial rims 27.

In another embodiment (not shown), the adaptor 10 is provided in a blister 50 without a cleaning pad.

Figure 9B:
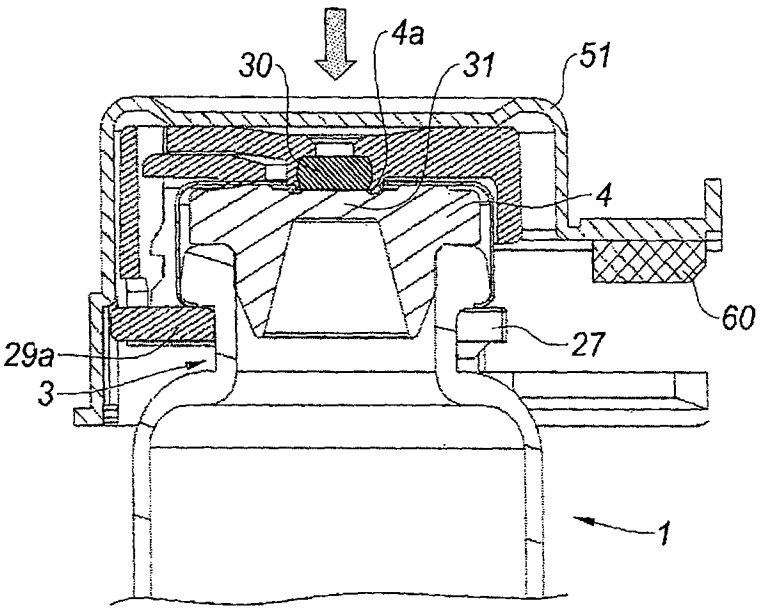
FIGS. 9A and 9B are cross section views of the adaptor of FIG. 8 once it is mounted on the collar of the vial, and once it is definitively secured on the collar of the vial, with the blister partially surrounding the adaptor.
Figure 9A:
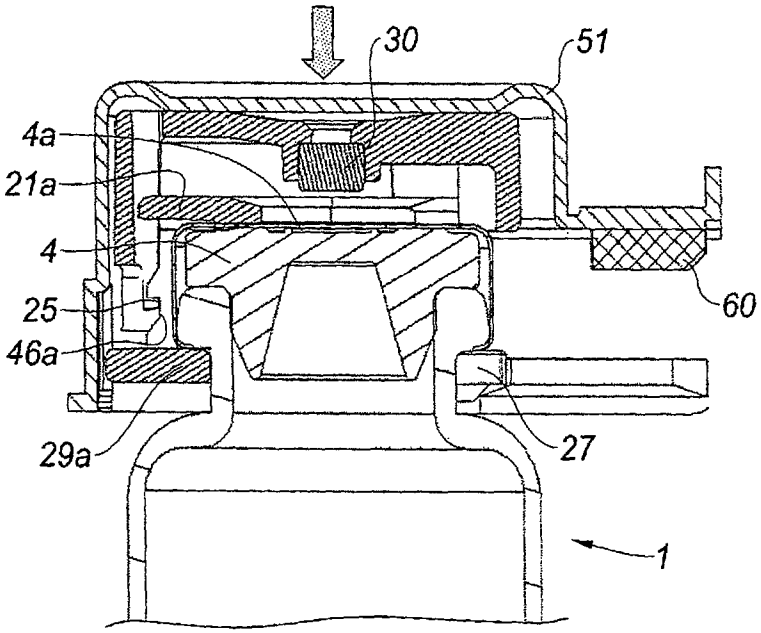

Back to FIG. 9A, once the adaptor 10 is secured on the collar 3 of the vial 1 by means of the gripping member 20, the user applies a distal pressure on top of the shell 51 in order to make the compressive member 40 transition from its inactive state to its active state, as shown on FIG. 9B. Under this distal pressure, the compressive member 40 has moved distally with respect to the gripping member 20: the inner radial pegs 46*a* have been able to escape the first rear recesses 25 by overcoming distal sloped faces 25*a*, and have become engaged in second rear recesses 26. In the same manner, inner radial pegs 45*a* have been able to escape first recesses 23 by overcoming distal sloped faces 23*a*, and have become engaged in second recesses 24, as shown on FIGS. 6A-6C and 9B.

As shown from FIG. 9B, the pierceable elastomeric piece 30 is now compressed and flexes under the pressure exerted by the compressive member 40 on the gripping member 20. In addition, as is clear from FIG. 9B, the distal face 31 of the elastomeric piece 30 has a surface which is complementary to that of the septum 4, and this surface is tightly and intimately in contact with the outer surface 4*a* of the septum 4 so that no foreign elements may be present between the distal face of the elastomeric piece 30 and the outer surface 4*a* now cleaned and disinfected.

In addition, by cooperation of the forward projection 29*a* and radial rims 27 coming in abutment on the collar 3 of the vial 1 and of the pegs (45*a*, 46*a*) of the compressive member 40 being engaged in the recesses (24, 26) of the gripping member 20, the adaptor is now secured on the collar in a permanent way and may not be removed.

In general, the adaptor 10 is thus secured on the collar 3 of the vial 1 in a two steps process. In the first step, the lateral gripping member 20 is mounted on the collar 3 by a lateral movement allowing an appropriate positioning, like for example the correct axial alignment of the elastomeric piece 30 of the adaptor 10 regarding the central hole 43 of the septum 4, but also a perfect transversal alignment of the distal face 31 of the elastomeric piece 30 and the outer surface 4*a* of the septum 4. The adaptor 10 is still in an inactive state as there is no contact between the elastomeric piece 30 and the septum 4. In the second step, the compressive member 40 is definitely secured on the collar 3 by a distal movement with respect to the gripping member 20. The adaptor is now in an active state with a close contact between the elastomeric piece 30 and the septum 4. Therefore, thanks to these two steps securing process, air-tightness between the elastomeric piece 30 and septum 4 is achieved avoiding any contamination.

Indeed, once the adaptor 10 is secured on the collar 3 of the vial 1, various contaminations of the inside vial 1 are avoided, and this ensures that the contents of the vial 1 will not be polluted.

The forward projection 29*a*, radial rims 27 and the recesses (24, 26) of the gripping member 20 form, in combination with the pegs (45*a*, 46*a*) of the compressive member 40, a fixing system for preventing the releasing of the gripping member 20 and definitively securing the adaptor 10 on the vial 1.

This fixing system allows the maintenance of a sufficient pressure between the distal face 31 of the elastomeric piece 30 and the outer face 4*a* of the septum 4 in order to ensure the air-tightness between these surfaces. Moreover, this fixing system is useful as it allows a very tight hermetic contact between the two pieces 30 and 4, even if the dimensions of the different parts of the adaptor are not always accurate due to the manufacturing tolerances which can be significant on all small plastic or elastomeric parts.

Additionally, this fixing system allows the free rotation of the vial 1 regarding to the adaptor 10 in order to let the user move the vial while maintaining the adaptor, for example when he needs to find the information he is looking for on a label present on the vial 1.

Figure 10A:
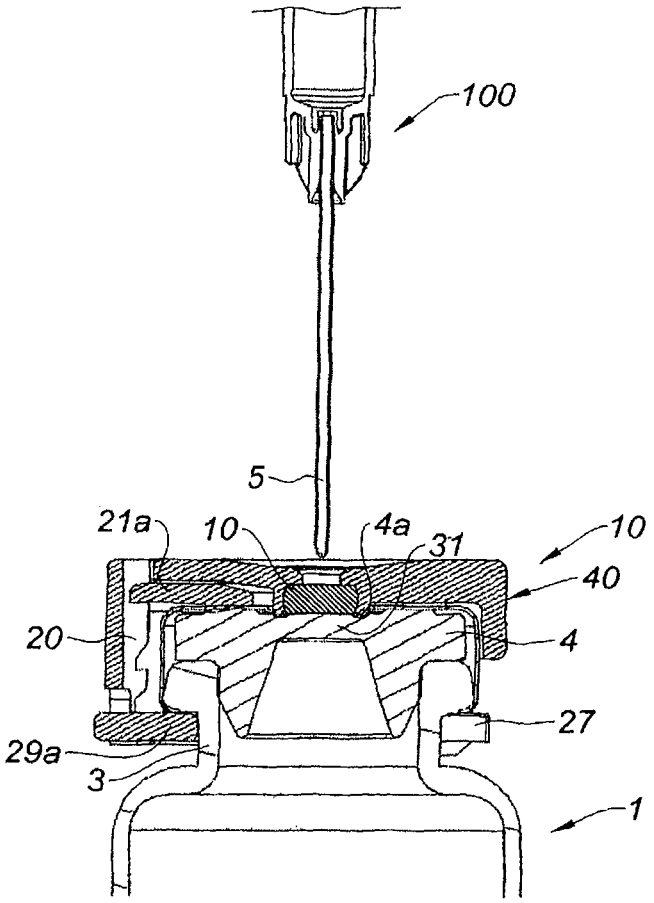
FIG. 10A is a partial cross section view of a needle of an injection device ready to pierce the elastomeric piece of the adaptor and assembly of FIG. 9B, once the blister has been fully removed, in order to remove a dose of product from the vial.
Figure 10B:
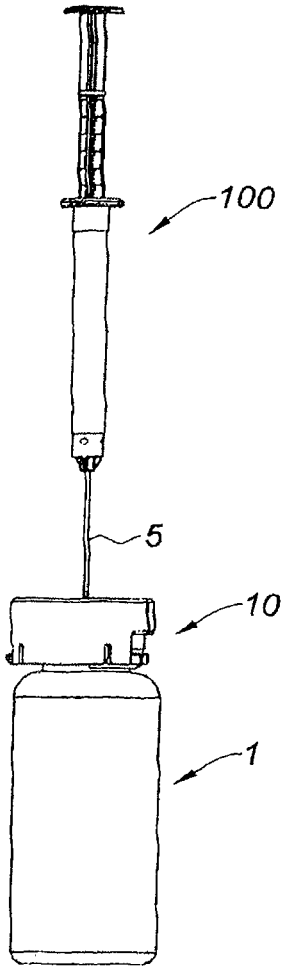
FIG. 10B is a side view of the injection device and assembly of FIG. 10A at a larger scale.

Then, when the adaptor is definitively secured on the vial, the user removes the shell 51 of the blister 50 and the adaptor 10 is ready to receive the needle 5 of an injection device 100, as shown on FIGS. 10A and 10B. It is therefore possible to pierce the elastomeric piece 30 of the adaptor 10 with the needle 5 and then subsequently pierce the septum 4, as many times as necessary, as explained above, with desired hygienic conditions.

In the embodiment where the cleaning pad 60 is provided on the blister 50, the cleaning pad, once contaminated by the cleaning of the septum 4, is disposed with the blister and can not disturb the user in removing a dose from the vial 1.

In the embodiment where the cleaning pad 60 is provided on a removable part of the adaptor 10 (not shown), the user may remove the pad once contaminated in order to prevent any disturbance during the dose withdrawal.

FIGS. 11A-15 show alternative embodiments of the adaptor 10 of FIGS. 1A-10B. References designating the same elements as in FIGS. 1A-10B have been maintained for FIGS. 11A-15.

Figure 11B:
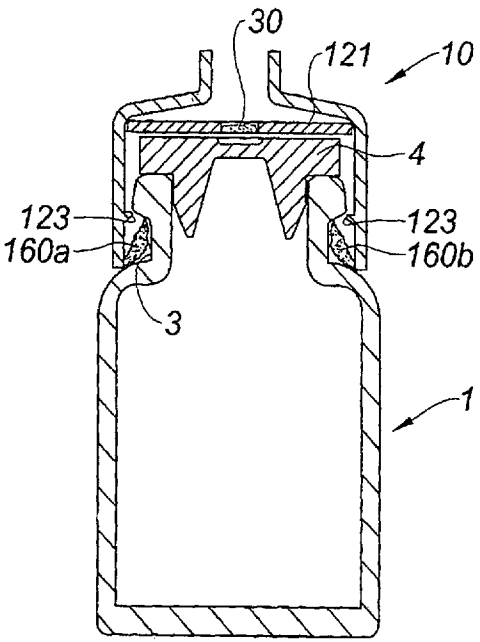
FIGS. 11A and 11*b* are schematic cross section views of another embodiment of the adaptor and assembly of the invention, in which the clipping member is axial and the cleaning pad is a breakable membrane.
Figure 11A:
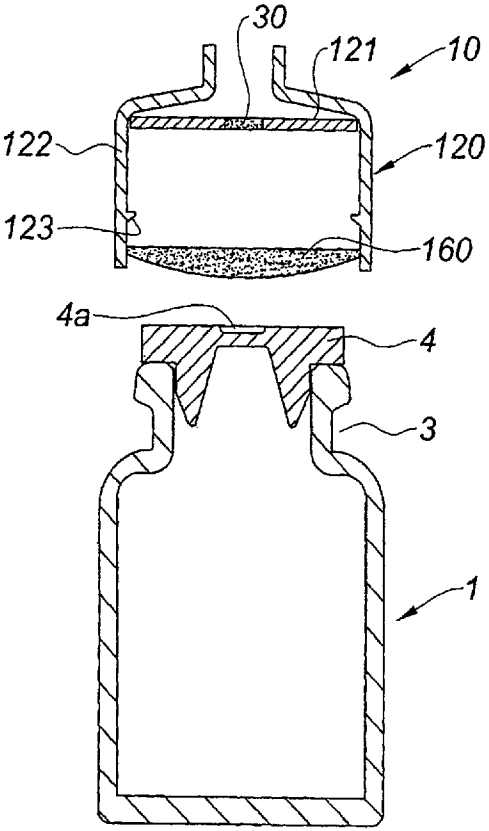

With reference to FIGS. 11A and 11B is shown schematically another embodiment of the adaptor 10 of the invention, in which the gripping member 120 is an axial clipping member comprising a tubular element 122 capable of being axially mounted on the collar 3 of the vial 1, by means of flexible radial pegs 123 engageable on the collar 3. In the embodiment shown, the adaptor 10 is provided with a transversal wall 121 located within said tubular element 122, and the cleaning pad is a breakable membrane 160 attached to the inner wall of the tubular element 122, and located distally with respect to the transversal wall 121.

As such, when the user approaches the distal free end of the tubular element 122 of the gripping member 120 towards the collar 3 of the vial 1, as shown on FIG. 11A, the breakable membrane 160 enters in contact with the outer surface 4*a* of the septum 4. While the user continues to move the gripping member 120 distally so as to mount it on the collar 3 of the vial 1, the breakable membrane 160, which is attached to the inner wall of the tubular element 122, becomes stretched out on the outer surface 4*a* of the septum 4 and finally breaks on said outer surface 4*a* and is torn in several parts that slide on said outer surface 4*a* while the gripping member 120 reaches its position where it is secured on the collar 3. In this position, as shown on FIG. 11B, because it is now torn in several parts (160*a*, 160*b*) hanging along the inner walls of the tubular element 122, the membrane 160 does not face the septum 4 anymore and it does not prevent the piercing of the septum 4 by the needle of an injection device (not shown). During the mounting step of the adaptor 10 on the collar 3 as described above, the sliding of the several torn parts (160*a*, 160*b*) of the breakable membrane 160 on the outer surface 4*a* of the septum 4 has wiped out the bacteria and/or contamination elements potentially present on said outer surface 4*a*. The outer surface 4*a* of the septum 4 is therefore decontaminated when the elastomeric piece 30 of the adaptor comes in contact with it, as shown on FIG. 11B.

In embodiments not shown, the adaptor of FIGS. 11A and 11B is packed before use in a blister comprising a shell closed at its distal end by a transversal pellicle film. In embodiments, the breakable membrane may be part of the blister and may be attached to the inner surface of the shell parallel to the distal transversal pellicle film.

Figure 12A:
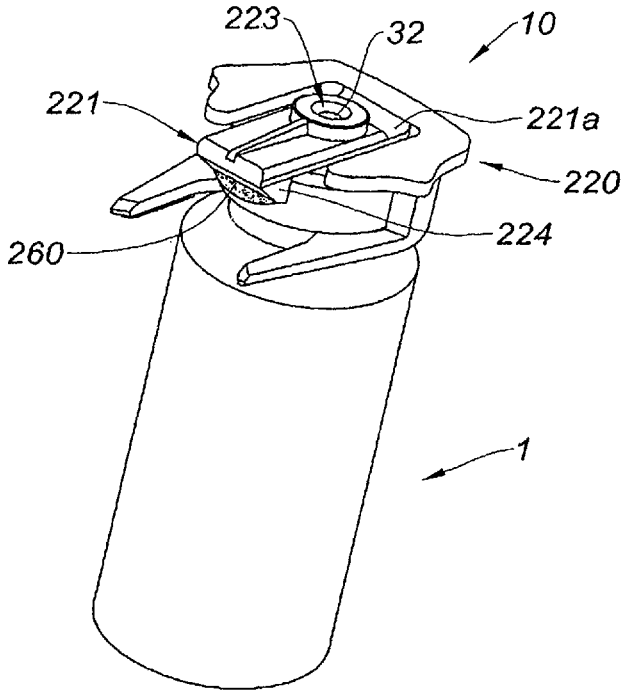
FIGS. 12A and 12*b* are respectively a perspective view and a partial perspective section view of another embodiment of an assembly of the invention.
Figure 12B:
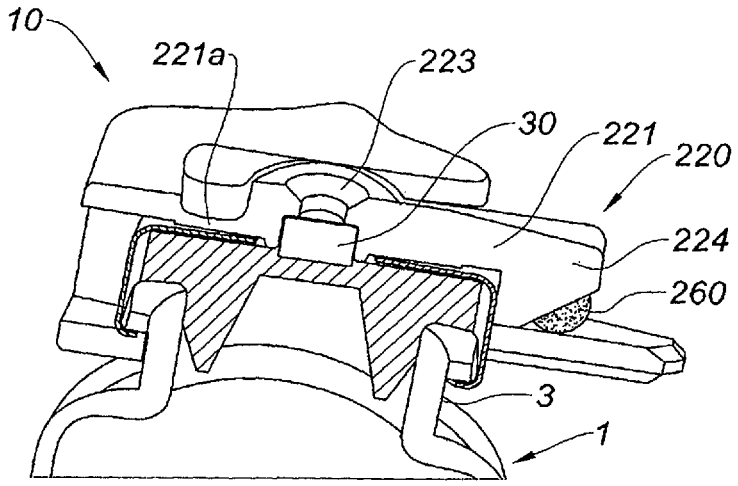

With reference to FIGS. 12A and 12B is shown another embodiment of the adaptor 10 of the invention, in which the cleaning pad 260 is part of the gripping member 220. In this embodiment, the gripping member 220 is a lateral clipping member comprising a transversal wall 221 provided with a hole 223 in which is lodged the elastomeric piece 30. The transversal wall 221 is proximally deflectable thanks to a rear hinge member 221*a* connecting the transversal wall 221 to the gripping member 220. The transversal wall 221 is provided with a front distal projection 224 bearing the cleaning pad 260. In this embodiment, the adaptor 10 does not comprise any compressive member.

When the adaptor 10 of FIGS. 12A-12B is mounted laterally on the collar 3 of the vial 1, the transversal wall 221 is pushed in a proximal direction when it contacts the collar 3. The cleaning pad 260 is therefore caused to slide onto the outer surface 4*a* of the septum 4, thereby cleaning and decontaminating said surface. The correct positioning of the adaptor 10 on the vial 1 is obtained when the collar 3 comes in abutment against the front distal projection 224 and the transversal wall 221 comes back to its non deflected position, as shown on FIG. 12B. In this position, the pierceable elastomeric piece 30 is in close contact with the septum 4 of the vial 1.

The gripping member 220 is therefore releasingly secured on the collar 3 of the vial 1. The transversal wall 221 is deflectable after the adaptor is mounted, for release of the vial 1 if necessary.

Figure 13:
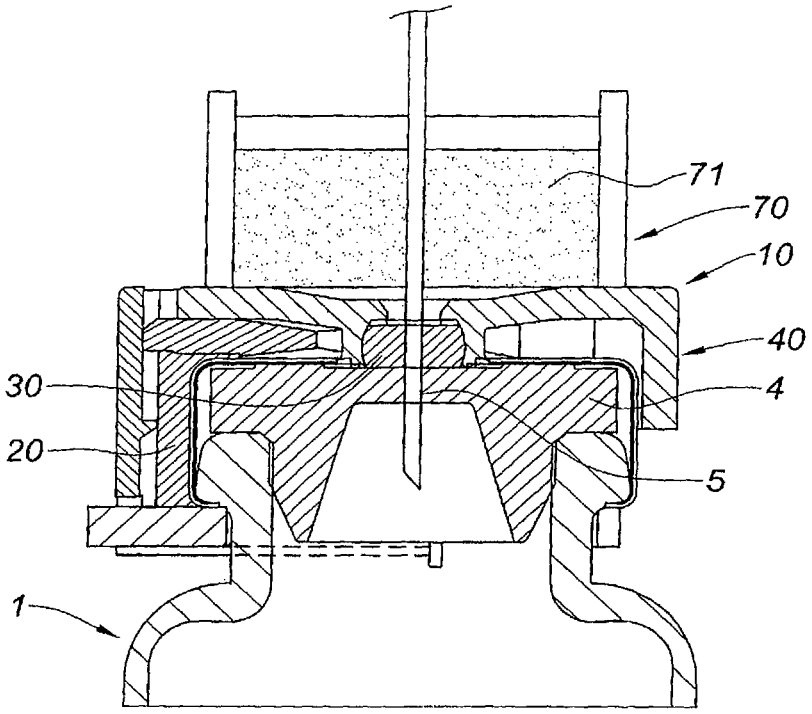
FIG. 13 is a cross section view of another embodiment of the adaptor and assembly of the invention, comprising a pierceable decontamination insert.

With reference to FIG. 13, is shown another embodiment of the adaptor 10 of the invention, in which a pierceable decontamination insert 70 is located proximally with respect to the elastomeric piece 30. On the embodiment shown, the decontamination insert 70 comprises a sterilizing gel 71. For proceeding to the withdrawal of a dose of product from the vial 1, the needle 5 first traverse the sterilizing gel 71, in which it is sterilized, then the elastomeric piece 30, in which it is submitted to a mechanical cleaning, before it contacts the septum 4. The piercing is therefore completed in improved hygienic conditions.

Figure 14:
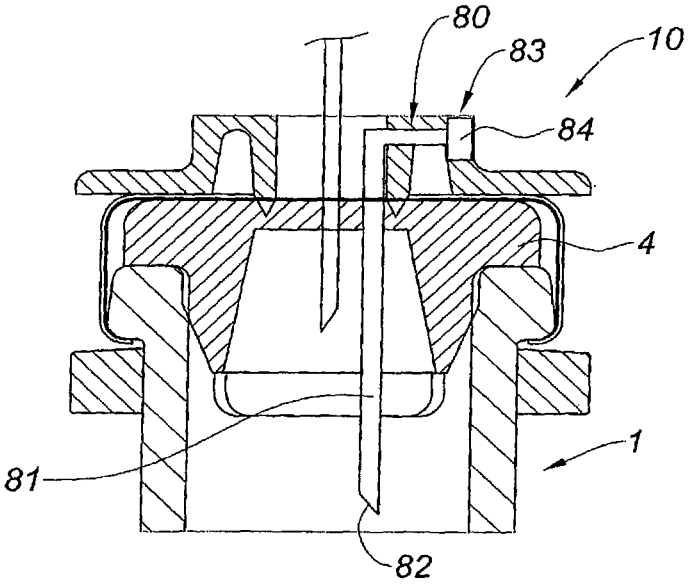
FIG. 14 is a cross view of another embodiment of the adaptor and assembly of the invention, comprising an air inlet.

With reference to FIG. 14, is shown another embodiment of the adaptor 10 of the invention, in which the adaptor 10 further comprises an air inlet 80 for allowing air entrance into the vial 1, once the adaptor 10 is secured on the vial 1. On the example shown, the air inlet 80 comprises a cannula 81 extending from the adaptor 10 in the distal direction and provided with a sharp distal tip 82, capable of piercing the septum 4 of the vial 1, the proximal end 83 of the cannula 81 protruding outside the adaptor 10 in outside environment. The air inlet 80 is provided with a filter 84 to restrict or prevent entry of contaminants such as particulates or bacteria from the ambient atmosphere into the vial 1, in particular during the vaccine withdrawal process. For example, this filter 84 has a pore size of 0.22 microns like for example a filter with Porex™ technology. Such embodiments are advantageous in the case the vial is made of glass or polymeric materials the walls of which are not collapsible. The presence of an air inlet prevents the formation of vacuum in the vial when medical fluid is withdrawn therefrom.

Figure 15:
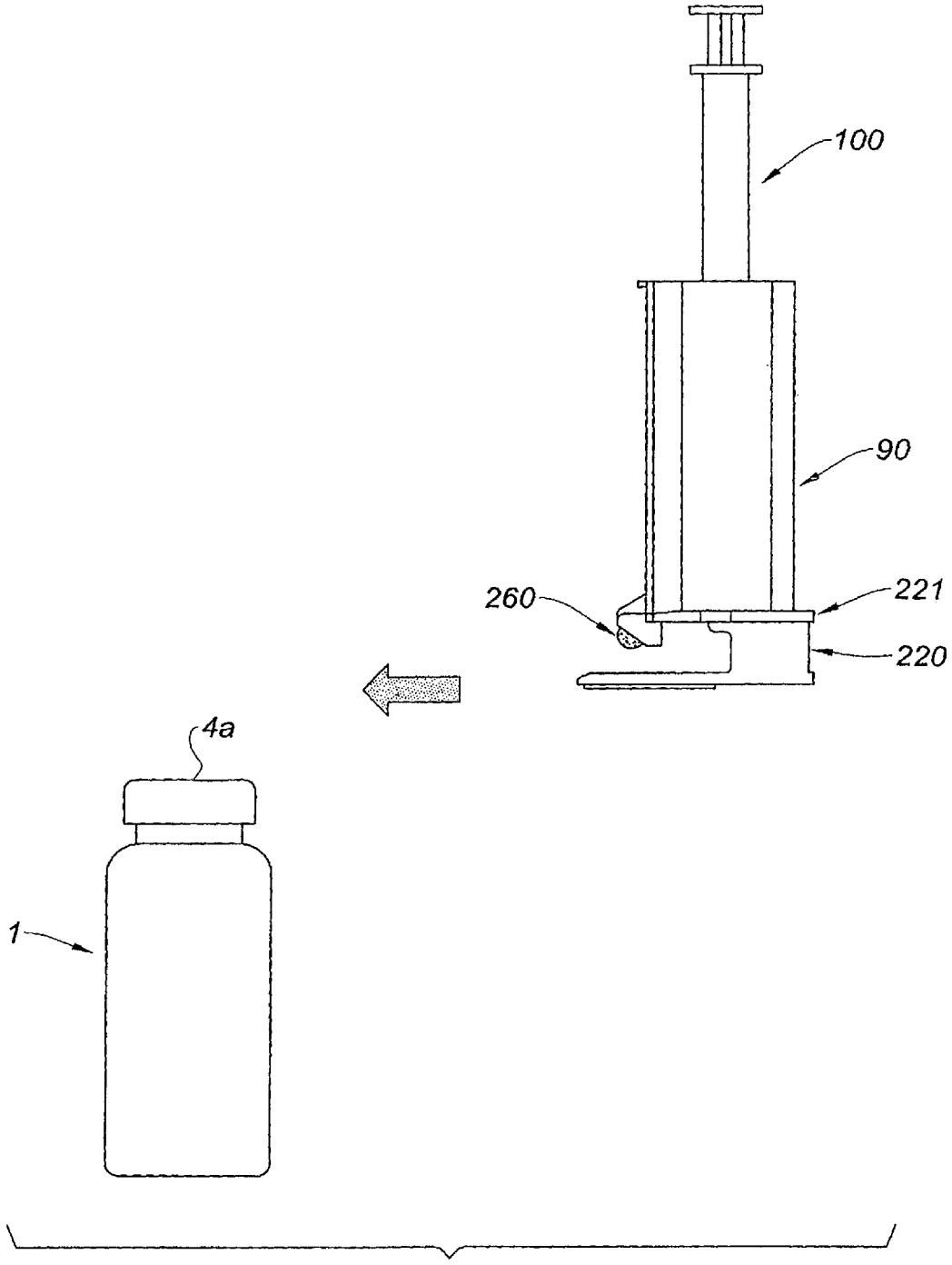
FIG. 15 is a side view of another embodiment of the adaptor and assembly of the invention, comprising a tubular lodging shaped and dimensioned for receiving an injection device.
Figure 16:
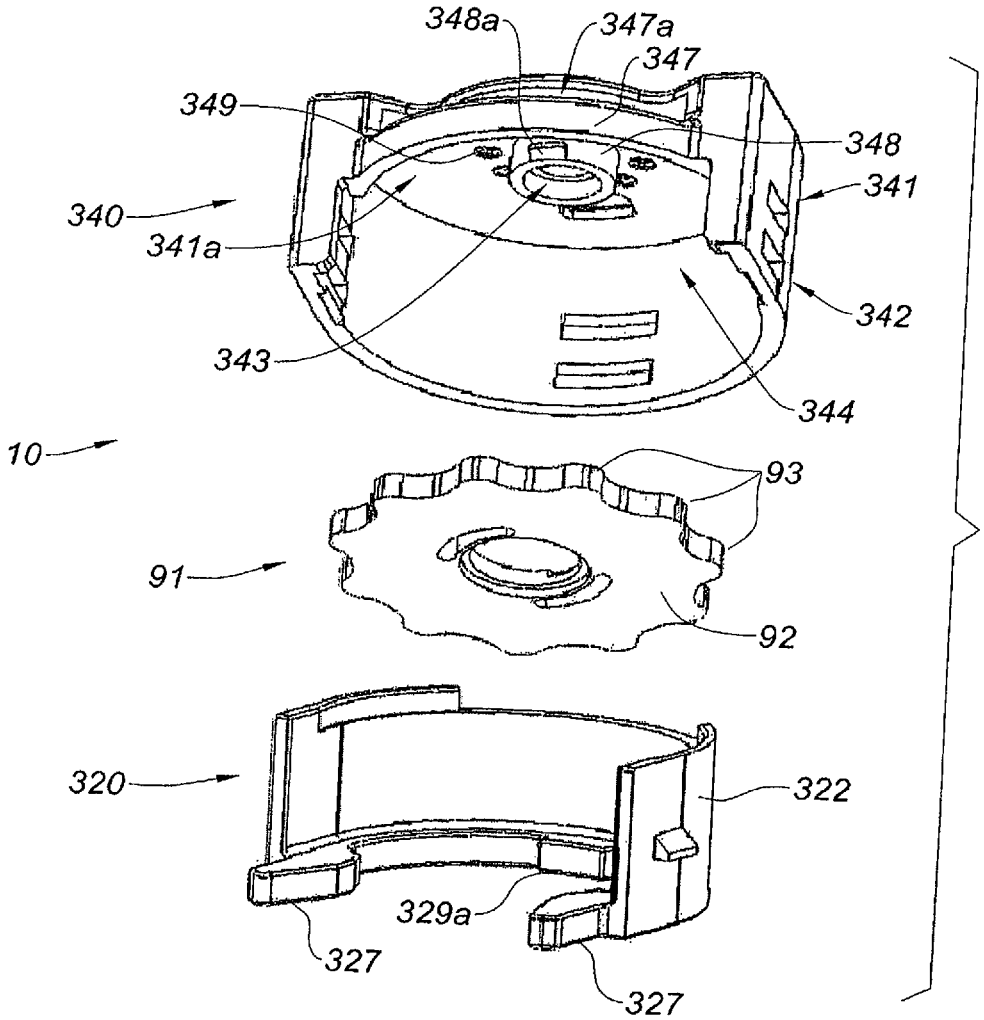
FIG. 16 is an exploded view of another embodiment of the adaptor of the invention, comprising a dose counter.

With reference to FIG. 15 is shown another embodiment of the adaptor 10 of FIGS. 12A and 12B, in which a tubular lodging 90 extends from the transversal wall 221 in the proximal direction, the tubular lodging 90 being shaped and dimensioned for receiving an injection device 100. For example, a cavity (not shown) filled with decontaminated atmosphere is provided in the tubular lodging 90, the needle of the injection device received in the tubular lodging 90 being lodged in said cavity. Such embodiments allow better hygienic and aseptic conditions for proceeding to the piercing of the outer surface 4*a* of the septum 4 of the vial 1, as the needle of the injection device does not enter in contact with outside environment before piercing.

With reference to FIGS. 16-18B is shown another variant of the adaptor 10 of FIGS. 2A-6B further comprising a dose counter 91. The references designating the same elements as in FIGS. 2A-6B have been maintained, augmented of 300.

With reference to FIGS. 16-18B, the compressive member 340 is formed of a cap 341 formed of a tubular wall 342 closed at its proximal end by a transversal wall 341*a* provided with a central hole 343. The tubular wall 342 is provided with an opening 344 on a part of its circumference and on its whole height, herein called "front part" of the compressive member 340, the opening 344 comprising a transversal bridge 347 defining a proximal window 347*a*. The proximal face of the transversal wall 341*a* is provided with an opening 341*b* (see FIG. 18A) radially spaced with respect to the center of the transversal wall 341*a*. The distal face of the transversal wall 341*a* is provided with a distally extending collar 348 surrounding the central hole 343. In the distal region of the outer wall of the distally extending collar 348 are located two opposite outer ears 348*a*, only one of them being visible on FIG. 16. The distal face of the transversal wall 341*a* is further provided with a plurality of circumferentially distributed recesses 349 located around the distally extending collar 348.

The dose counter 91 is made of a flat cylinder 92 provided with a plurality of circumferentially distributed peripheral projections 93 extending radially outwardly. The flat cylinder 92 is further provided with a central hole 94 dimensioned and shaped so as to fit around the distally extending collar 348 of the distal face of the transversal wall 341*a* of the compressive member 340, and so as to be snap-fitted thereon after overcoming the outer ears 348*a* of said distally extending collar 348. The flat cylinder 92 is snap-fitted on the collar 348 so that it is able to rotate with respect to said collar 348.

Figure 17:
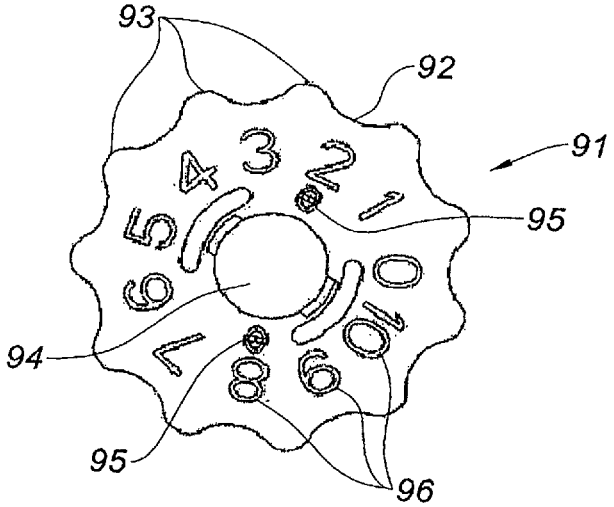
FIG. 17 is a top perspective view of the dose counter of the adaptor of FIG. 16, FIGS. 18A and 18B are respectively a top perspective view and a bottom perspective view of the adaptor of FIG. 16, FIGS. 19A and 19B are respectively a top perspective view of an opened vial collar ring and a bottom perspective view of a closed vial collar ring.

With reference to FIG. 17, the proximal face of the flat cylinder 92 is further provided with two proximal pegs 95 located around the central hole 94. As will be shown later, these two proximal pegs 95 are intended to cooperate with the recesses 349 of the distal face of the transversal wall 341*a* of the cap 341 of the compressive member 340. The proximal face of the flat cylinder 92 is further provided with a plurality of circumferentially distributed information data 96, such as digits from "0" to "10" on the example shown.

Figure 18B:
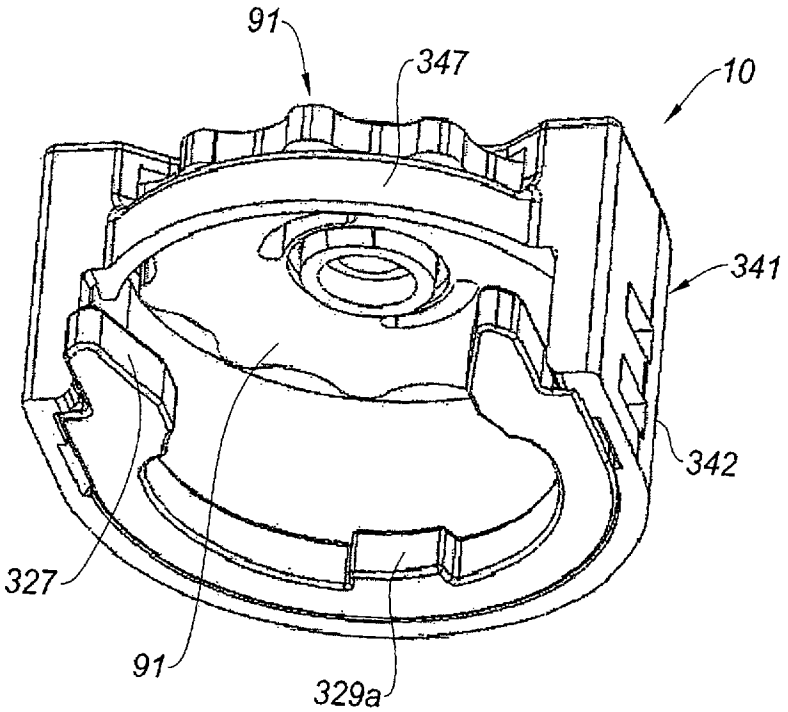
Figure 18A:
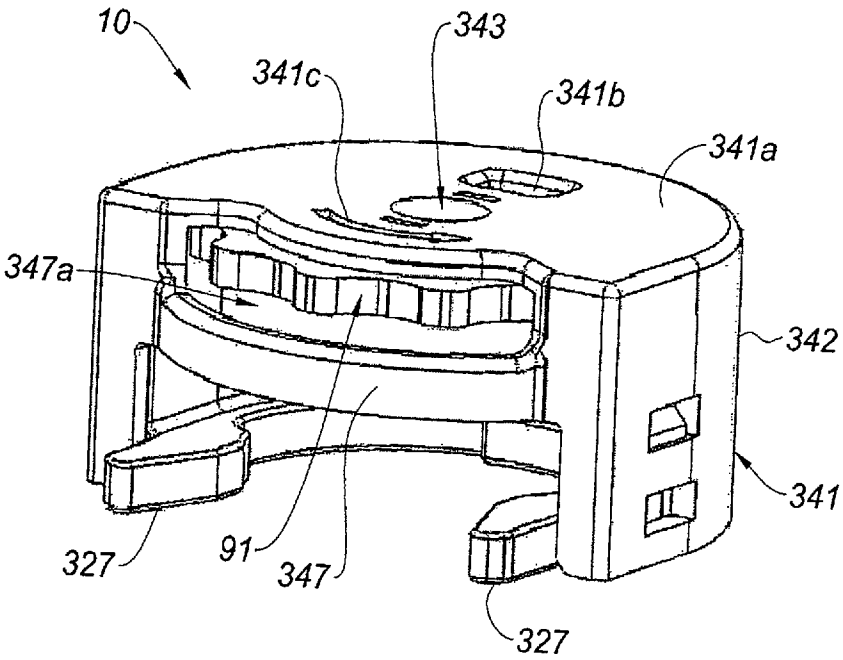

When the adaptor 10 is assembled, as shown on FIGS. 18A and 18B, the flat cylinder 92 is snap-fitted onto the distally extending collar 348 of the distal face 341*a* of the cap 341 and it is therefore received within said cap 341 with a part of it protruding outside via the window 347*a*. The flat cylinder 92 is capable of rotating with respect to the collar 348, therefore with respect to transversal wall 341*a*. Anyway, before use, one of the information data, for example digit "0" faces the opening 341*b* of the transversal wall 341*a* and it is therefore visible by the user. In addition, in order to temporarily maintain the flat cylinder 92 in this position with respect to the transversal wall 341*a*, the proximal pegs 95 are each engaged in one of the plurality of circumferentially distributed recesses 349 located around the distally extending collar 348.

The user then uses the adaptor 10 in the same way as described for FIGS. 1A-6B in order to withdraw a dose of product from a medical container. He then rotates the flat cylinder 92, for example manually by grasping one of the plurality of circumferentially distributed peripheral projections 93 extending radially outwardly, for example in the direction of the arrow 341*c* shown on FIG. 18A. With this rotational movement, the proximal pegs 95 overcome the recesses 349 in which they were engaged, and become engaged in adjacent recesses 349, in which position the digit "1" now appears through opening 341*b* of the proximal face of the transversal wall 341*a*.

The flat cylinder 92 therefore forms a dose counter for counting how many doses of product have already been withdrawn or remain from the medical container.

Figure 19B:
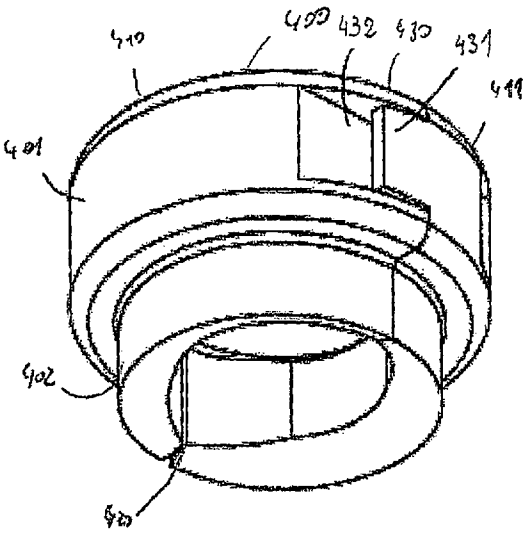
Figure 19A:
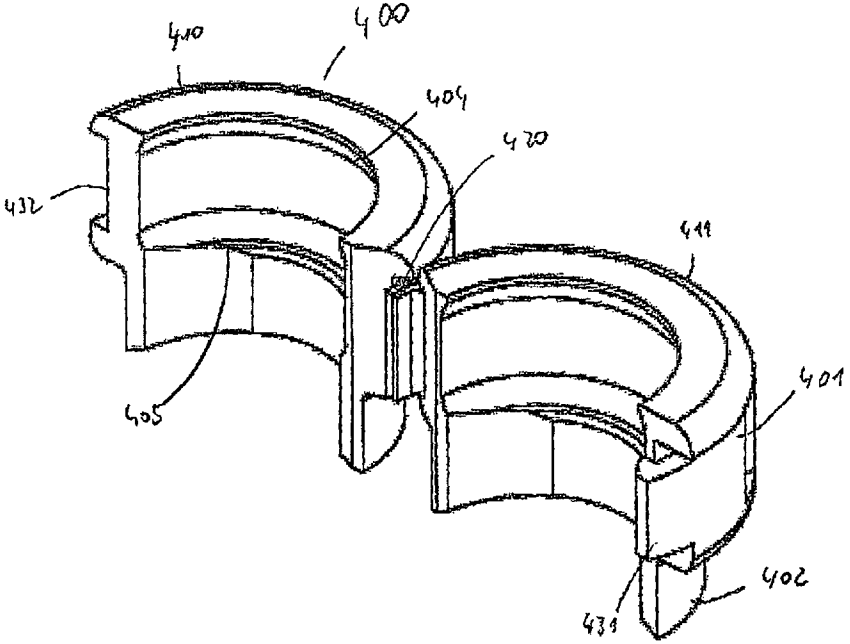
Figure 20:
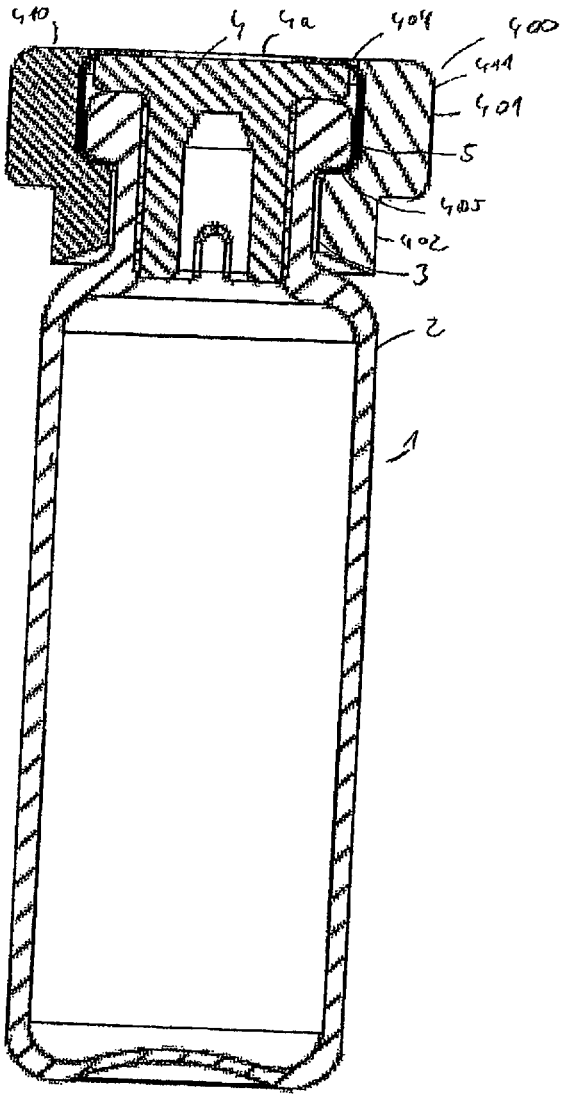
FIG. 20 is a cross view of a closed vial collar ring mounted onto a vial.

In embodiments, the clipping member of the adaptor is adapted to receive large diameter vials, with a collar having typically a diameter of 20 mm, and is not compatible with small diameter vials having typically a collar with a diameter of 13 mm. Therefore, with reference to FIGS. 19A-20, a vial collar ring 400 may be provided to be used on small diameter vials in order to fit with the adaptor of the present invention. On FIGS. 19A, 19B and 20, a vial collar ring 400 is provided with two cylindrical portions: a top portion 401 with a large diameter capable of enclosing the vial septum 4 and the peripheral band 5 between the abutment 404 and 405, and a bottom portion 402 having a small diameter in order to enclose the vial collar 3. This vial collar ring 400 consists in two hemi-rings 410 and 411 connected together for example by a hinge 420 that can be plugged together on their free extremity by a snap-in lock 430. The snap-in lock comprises a recess 432 on the first hemi-ring 410 and a snap-in portion 431 on the second hemi-ring 411. Thanks to this snap-in lock 430 and the hinge 420, the vial collar ring 400 can either be provided in an open state (FIG. 19A) or in a closed state (FIGS. 19B and 20).

The vial collar ring can be plugged onto a small diameter vial. Then, the adaptor of the present invention can be mounted on the small diameter vial equipped with the vial collar ring 400.

In embodiments, the adaptor of the present invention is provided with a time monitoring system. Indeed, such an adaptor is used to prevent contamination of the content of vial 1 for a limited period of time, for example up to 28 to 30 days. Therefore, a time monitoring system can be added to the adaptor in order to monitor the elapsing time from the first dose withdrawing or to indicate to the user what is the time remaining before the 28 or 30 days deadline.

This time monitoring system may be an electronic timer or a system based on the diffusion of ink into a circuit. For example, the elapsing or remaining time can be monitored by the kinetic of ink progression in a microfluidic circuit.

Such systems are particularly attractive because they are small and reliable. For example some of them are commercially available under the trademark Timestrip®.

Furthermore, the time monitoring system may be triggered either manually by the user or automatically. An automatic trigger could occur when the adaptor is mounted on the collar 3 of the vial 1 which assumes a first dose withdrawing shortly afterwards. For example, such time monitoring label, placed on an adaptor 10 could be triggered by an additional peg (not shown) placed into the blister 50 that comes in contact with the time monitoring system and therefore activates it when the user applies a distal pressure on the top of the shell 51.

Figure 21:
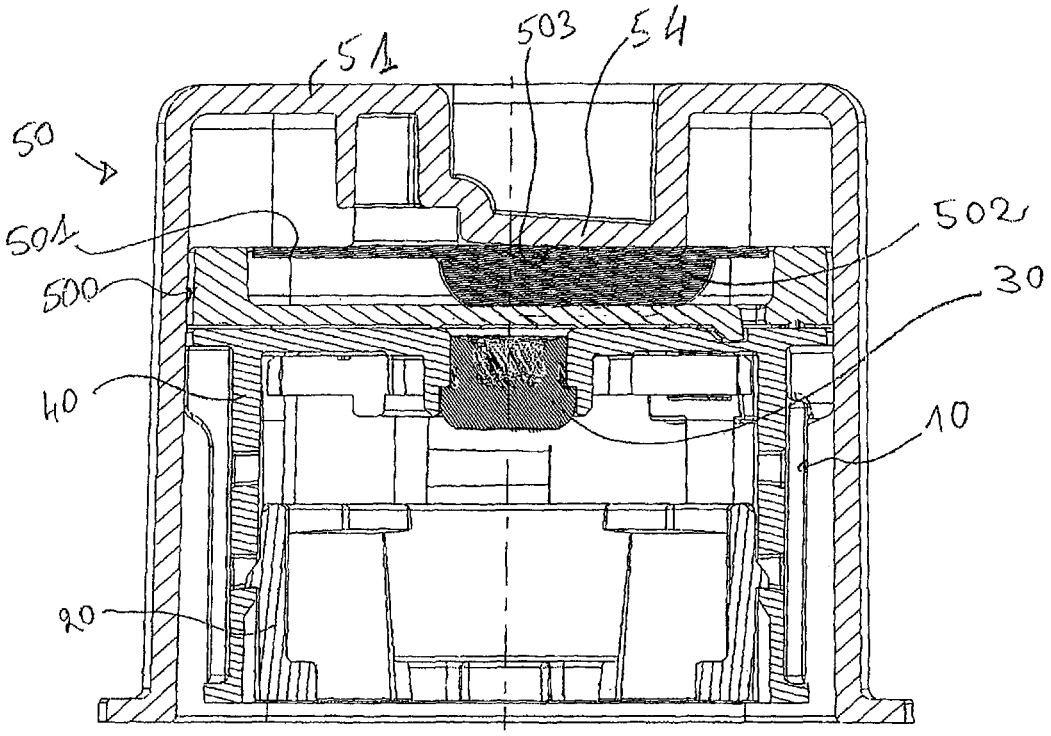
FIG. 21 is a cross section view of an adaptor of the invention provided with a monitoring system and partially surrounded by a blister, before triggering of the monitoring system.
Figure 22:
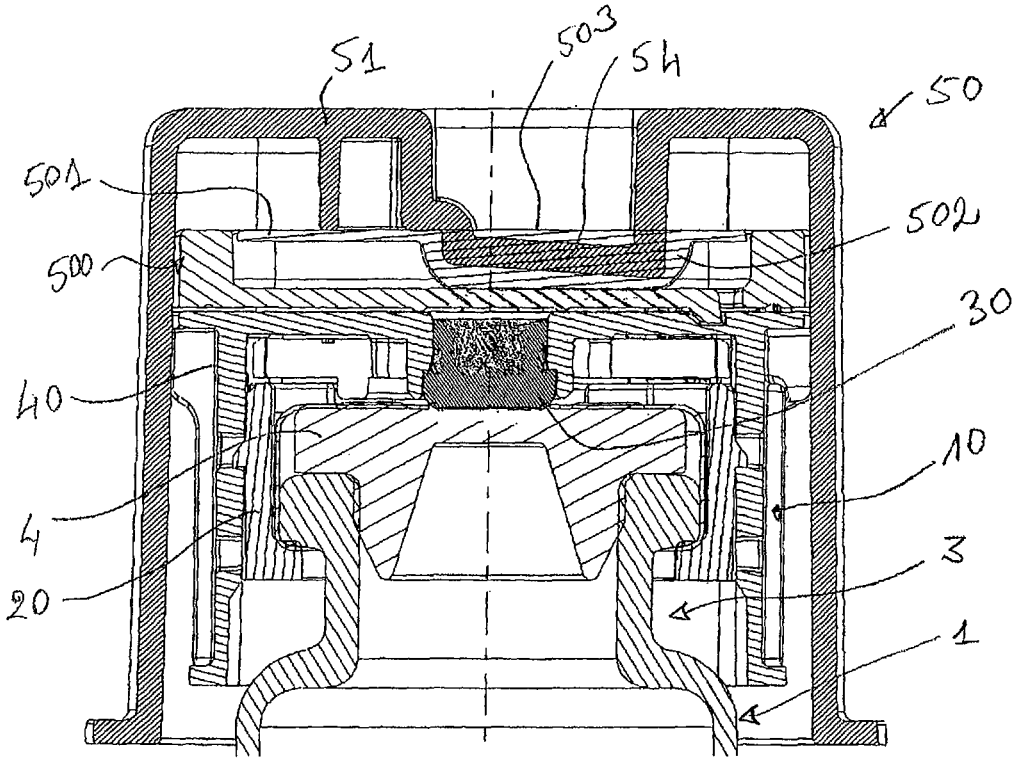
FIG. 22 is a cross section view of the adaptor of FIG. 21, once the adaptor is mounted on the collar of a vial and the monitoring system has been triggered.

FIGS. 21 and 22 show an alternative embodiment of the adaptor 10 of FIGS. 1A-10B, provided with a monitoring system, and surrounded by a blister 50 in a storage state of the adaptor. References designating the same elements as in FIGS. 1A-10B have been maintained for FIGS. 21-22.

With reference to FIGS. 21 and 22, the adaptor 10 is provided with a time monitoring system under the form of a support member 500 provided with a microfluidic circuit 501 connected to an ink reservoir 502 closed by a pellicle film 503, similar to the commercially available product sold under the tradename Timestrip® by the company Timestrip Ltd, UK. The shell 51 of the blister 50 is provided with a distal peg 54.

As seen on FIG. 21, in a storage state of the adaptor 10, the blister 50 surrounds the adaptor 10 and the distal peg 54 is adjacent to the pellicle film 503 of the ink reservoir 502 without interacting with said pellicle film 503.

The adaptor 10 is then mounted laterally onto the collar 3 of the vial in the same manner as that described with respect to FIGS. 7 to 9A above. The presence of the blister 50 allows protecting the adaptor 10 from potentially contaminated hands or surfaces during this mounting step. Once the adaptor 10 and the blister 50 are secured on the collar 3 of the vial 1 by means of the gripping member 20, the user applies a distal pressure on top of the shell 51, as described in FIG. 9B in order to make the compressive member 40 transition from its inactive state to its active state as shown on FIG. 22.

Under this distal pressure, the distal peg 54 enters in contact with the pellicle film 503 of the ink reservoir 502 and causes it to burst. The time monitoring system is thereby triggered as the ink previously present in the ink reservoir 502 is now capable of diffusing into the microfluidic circuit 501. The kinetic of ink progression in the microfluidic circuit 501 will from now on inform the user of the elapsed time since the adaptor 10 was mounted onto the collar 3 of the vial 1, or alternatively of the remaining time before the drug contained in the vial 1 expires.

Such a system may prevent the injection of potentially expired vaccines or drugs to patients, but may also facilitate the supply chain or stock management in drugstores or even avoid wastage of valuable drugs and vaccines by encouraging the use of the first opened vials.

The adaptor and assembly of the invention allow piercing the septum of a multidose vial yielding favorable hygienic and aseptic conditions multiple successive times. Indeed, with the adaptor of the invention, introducing the needle of an injection device into the septum of a vial entails the needle piercing and traversing the elastomeric piece of the adaptor in the first place. During this step, the needle mechanically rubbing against the material forming the elastomeric piece and it is cleaned, as potential bacteria are wiped from the needle when said needle penetrates the elastomeric piece. In addition, once the needle protrudes out of the elastomeric piece of the adaptor, it directly enters the septum of the vial and may therefore not be contaminated by foreign elements.

The user may repeat the piercing step with the needle of a new empty syringe until all the doses contained in the vial are removed. The adaptor of the invention acts as a protection of the septum of the vial.

The pierceable elastomeric piece of the adaptor of the invention and the septum of the medical container are in contact, for example in tight contact, once the adaptor is secured onto the medical container. In embodiments where both the pierceable elastomeric piece of the adaptor of the invention and the septum of the medical container are self-resealing, no possibility of communication exist between the inside of the medical container and the outside environment at the time the needle of the injection device is removed from both the septum and the pierceable elastomeric piece, after withdrawal of a dose of product from the medical container. This therefore restricts or prevents the product contained in the medical container from being contaminated by outside contaminants such as bacteria, unpurified water, particles, viruses, etc. . . . . The adaptor of the invention thus allows a hermetic sealing of the contents of the medical container it is secured on, even during the removal of the needle. The inside of the medical container is kept in aseptic conditions before, during and after a withdrawal of a dose from the medical container.

The invention claimed is:

1. An adaptor for coupling with a medical container having a collar closed by a septum, said septum having an outer surface directed towards the outside of the medical container, the adaptor comprising:

a gripping member configured to secure the adaptor to the medical container, said gripping member being capable of being mounted on the collar of said medical container;

a pierceable elastomeric piece having at least a part configured to come into direct contact with the outer surface of the septum when said adaptor is secured on said medical container, wherein said gripping member comprises a tubular element capable of being axially mounted on the collar of said medical container, and further comprising:

a transversal wall located within said tubular element; and a cleaning pad, wherein the cleaning pad is a breakable membrane attached to the inner wall of the tubular element, and located distally with respect to the transversal wall.

2. The adaptor of claim 1, wherein the tubular element comprises flexible radial pegs engageable on the collar of said medical container.

3. The adaptor of claim 1, further comprising a pierceable decontamination insert located proximally with respect to said pierceable elastomeric piece.

4. The adaptor of claim 1, further comprising an air inlet that comprises a cannula extending from the adaptor in a distal direction and capable of piercing the septum of the medical container, a proximal end of the cannula protruding outside the adaptor in an outside environment.

5. The adaptor of claim 4, wherein the air inlet comprises a filter.

6. The adaptor of claim 1, further comprising a dose counter configured to count a number of doses of product that have been withdrawn from the medical container or remain within the medical container.

7. The adaptor of claim 1, further comprising a time monitoring system.

8. The adaptor of claim 7, wherein a blister surrounds said adaptor in a storage state, the time monitoring system being capable of being triggered once the adaptor is mounted on the collar of the drug container, by a peg of the blister coming in contact with the time monitoring system when a user applies a distal pressure on a shell of the blister.

9. An assembly for coupling with a medical container having a collar closed by a septum, said septum having an outer surface directed towards the outside of the medical container, the assembly comprising:

an adaptor for coupling with the medical, the adaptor having a gripping member configured to secure the adaptor to the medical container, said gripping member being capable of being mounted on the collar of said medical container, and a pierceable elastomeric piece having at least a part configured to come into direct contact with the outer surface of the septum when said adaptor is secured on said medical container, wherein said gripping member comprises a tubular element capable of being axially mounted on the collar of said medical container, and wherein the adaptor further comprises a transversal wall located within said tubular element and a cleaning pad, wherein the cleaning pad is a breakable membrane attached to the inner wall of the tubular element, and located distally with respect to the transversal wall; and a vial collar ring configured to couple to the collar of the medical container, wherein said gripping member is capable of being mounted on the vial collar ring to mount the gripping member on the collar of said medical container.

10. The assembly of claim 9, wherein the vial collar ring comprises a top cylindrical portion with a diameter capable of enclosing a peripheral band of the medical container, the peripheral band including the septum of the medical container, and a bottom cylindrical portion having a smaller diameter than the top cylindrical portion and capable of enclosing the collar of the medical container.

11. The assembly of claim 9, wherein the vial collar ring comprises two hemi-rings connected together by a hinge.

* * * * *